US006878496B2

(12) United States Patent
Asano et al.

(10) Patent No.: US 6,878,496 B2
(45) **Date of Patent: *Apr. 12, 2005**

(54) ELECTROPHOTORECEPTOR, IMAGE FORMING METHOD, IMAGE FORMING APPARATUS AND PROCESSING CARTRIDGE

(75) Inventors: Masao Asano, Tokyo (JP); Tomoo Sakimura, Tokyo (JP); Hirofumi Hayata, Tokyo (JP); Shinichi Hamaguchi, Tokyo (JP)

(73) Assignee: Konica Corporation, Tokyo (JP)

( * ) Notice: Subject to any disclaimer, the term of this patent is extended or adjusted under 35 U.S.C. 154(b) by 169 days.

This patent is subject to a terminal disclaimer.

(21) Appl. No.: 10/155,251

(22) Filed: May 24, 2002

(65) Prior Publication Data

US 2003/0082470 A1 May 1, 2003

(30) Foreign Application Priority Data

| | | |
|---|---|---|
| Jun. 6, 2001 | (JP) | 2001-170885 |
| Jun. 14, 2001 | (JP) | 2001-179963 |
| Jun. 20, 2001 | (JP) | 2001-186366 |
| Jul. 17, 2001 | (JP) | 2001-216655 |

(51) Int. Cl.[7] ..... G03G 5/14
(52) U.S. Cl. ..... 430/65
(58) Field of Search ..... 430/65

(56) References Cited

U.S. PATENT DOCUMENTS

| | | | | |
|---|---|---|---|---|
| 4,948,690 A | * | 8/1990 | Hisamura et al. | 430/60 |
| 5,932,385 A | * | 8/1999 | Takamura et al. | 430/63 |
| 6,620,567 B2 | * | 9/2003 | Sakimura et al. | 430/60 |

FOREIGN PATENT DOCUMENTS

| | | |
|---|---|---|
| JP | 60-032056 | 2/1985 |
| JP | 60-252359 | 12/1985 |
| JP | 03-179362 | 8/1991 |
| JP | 08-248651 | 9/1996 |

* cited by examiner

*Primary Examiner*—Mark A. Chapman
(74) *Attorney, Agent, or Firm*—Squire, Sanders & Dempsey

(57) ABSTRACT

An electrophotographic photoreceptor having an interlayer between an electroconductive support and a photoreceptive layer, wherein the interlayer contains an N-type semiconductive particle and a binder and a Benard cell is formed in the interlayer.

26 Claims, 11 Drawing Sheets

TONER HAVING NO CORNERS

TONER HAVING CORNERS

TONER HAVING CORNERS

ELECTROPHOTORECEPTOR, IMAGE FORMING METHOD, IMAGE FORMING APPARATUS AND PROCESSING CARTRIDGE

FIELD OF THE INVENTION

This invention relates to an electrophotographic photoreceptor, hereinafter referred to as a photoreceptor, to be used in the field of copy machine and printer, an image forming method, an image forming apparatus and a processing cartridge each using such the photoreceptor.

BACKGROUND OF THE INVENTION

The main stream of the photoreceptor to be used in the electrophotography has been changed from an inorganic photoreceptor to an organic photoreceptor which has advantages such as reducing of environment contamination and ease of the production. Therefore, organic photoreceptors using various materials have been developed.

Recently, function separated type photoreceptors are mainly used in which different materials are each separately put in charge of the function of charge generation and that of charge transportation. Among then, a multi-layered type photoreceptor is widely used, in which a charge generation layer and a charge transportation layer are laminated.

Besides, in the image forming process, the image forming method can be roughly classified into an analogical method using a halogen lamp as the light source and a digital method using a LED or laser light source. The digital latent image forming method is rapidly become to the main stream of both of the printer for forming a hardcopy by a personal computer and a copy machine for common use since such the method is easily applied for image processing and for combined image forming machine.

In the digital image formation, a laser, particularly a semiconductor laser or a LED, is used as the light source for writing image information converted to digital electric signals as a static latent image on the photoreceptor. As to the image formation by the laser light, a peculiar problem of formation of interference fringes has been known which is caused by the reflection of the light at the surface of the photoreceptor.

Moreover, the writing speed is lowered in the writing by the digital method since the diameter of the light beam for writing is small. Therefore, a reversal development is mainly applied for developing the exposed area. It has been known that a problem of formation of a black spot caused by a local defect of the photoreceptor is peculiarly accompanied with the reversal development. The formation of the black spot is a phenomenon that the toner is adhered to form fogging at a portion to be made as a white background of the image.

On the other hand, a belt type photoreceptor is proposed and practically used as the electrophotographic photoreceptor. The belt type photoreceptor is utilized for a high speed or color image forming apparatus since the belt type photoreceptor is flexible so as to have a high freeness of design and the durability of it can be made larger than that of the drum type photoreceptor. Furthermore, it is proposed to apply the belt type photoreceptor to a compact apparatus by making small the suspending roller of the photoreceptor belt.

However, the belt type photoreceptor suffers considerably serious force by the stress caused by the curvature of roller such as the driving roller and the suspension roller and that caused by the tension while driving and standing. Accordingly, peeling off of the jointed portion of the photoreceptor belt and scattering of the powder of the binder and cracking of the photoreceptive layer are tend to be occurred in the course of repeated used since the adhesive force between the support or the lower layer is weak. As a result of that, a problem of the image defect formation causing the black spot is easily to be occurred.

Besides, it has been recently required from the viewpoint of the space saving to make compact the electrophotographic image forming apparatus such as the copy machine and the printer to be used in an office. The electrophotographic image forming apparatus is generally constituted by a charging means, a developing means, a transfer means, a cleaning means and a discharging means each arranged around the photoreceptor. Therefore, the size of the electrophotographic image forming apparatus is strongly depended on the diameter of the photoreceptor. It is necessary to make small the diameter of the photoreceptor arranged at the center of the apparatus for making compact the electrophotographic image forming apparatus. Consequently, the proposition of the photoreceptor having a small diameter is demanded. The thickness of the layer of the organic photoreceptor is generally at least 17 $\mu$m. It has been tried to make larger the dry thickness of the photoreceptive layer for extending the durability or life of photoreceptor. However, the thickened layer causes a problem that the adhesion ability between the support and the photoreceptive layer or an interlayer and the photoreceptive layer is degraded since the interior stress in the photoreceptive layer is increased accompanied with the increasing the layer thickness. The adhesion ability is lowered accompanied with increasing of the layer thickness and decreasing of the diameter of the cylindrical support. Consequently, the peeling off of the photoreceptive layer is occurred in the course of the repeating use when the diameter of the photoreceptor is simply made small. Such the tendency is become considerable in the photoreceptor having a diameter of 50 mm or less.

For improving the adhesion ability, methods have been known such as roughing the support surface, arranging an adhesive layer between the photoreceptive layer and the support, and raising the adhesion ability of the charge generation layer when the photoreceptive layer comprises a piled layer of the charge generation layer and the charge transportation layer, have been known. These methods, however, cannot improve the durability of the photoreceptor since such the methods give an undesirable effect on the static or photographic property of the photoreceptor.

Japanese Patent Publication to Open for Public Inspection, hereinafter referred to as JP O.P.I., No. 03-179362 describes a method by which a cell structure, Benard cell, is formed in the subbing layer for roughing the surface thereof but the method causes an image defect since the effect of the method cannot be controlled. JP O.P.I. No. 08-248651 described that the leveling property of the subbing layer is degraded by the formation of the Benard cell at the time of immersion coating of and the electrophotographic property is lowered. Generally, the formation of the Benard cell has been considered as an undesirable matter and reduction of the Benard cell has been tried.

Although JP O.P.I. Nos. 60-32056 and 60-252359 positively describe a electroconductive layer and an interlayer each having the Benard cell, the object of the investigation is a countermeasure to moire, and there is no description regarding the relation to the black spot formation or the improvement on the electrophotographic property.

SUMMARY OF THE INVENTION

The object of the invention is to provide an electrophotographic photoreceptor which is stabile in the electric potential and causes no image defect such as the black spot. The object of the invention in detail is to provide the electrophotographic photoreceptor having an interlayer which causes no image defect such as the black spot, and is stable in the electric potential in the course of repeating use, and an image forming method, image forming apparatus and a processing cartridge each using such the photoreceptor.

It is found by the inventors that the photoreceptor can be used for a prolonged period without formation of an image defect such as the black spot, decreasing of the image density, fogging and cracking by using an interlayer containing an N-type semiconductive particle and forming a Benard cell in the interlayer.

The invention and embodiments thereof are described below.

1. An electrophotographic photoreceptor having an interlayer between an electroconductive support and a photoreceptive layer, wherein the interlayer contains an N-type semiconductive particle and a binder and a Benard cell is formed in the interlayer.

2. The electrophotographic photoreceptor described in the foregoing 1, wherein the N-type semiconductive particle is subjected to plural times of surface treatment and the final surface treatment is carried out by using a reactive organic silicon compound.

3. The electrophotographic photoreceptor described in the foregoing 2, wherein the reactive organic silicon compound is methylhydrogenepolysiloxane.

4. The electrophotographic photoreceptor described in the foregoing 2, wherein the organic silicon compound is a compound represented by the following Formula 1:

$$R—Si—(X)_a \qquad \text{Formula 1}$$

In the formula, R is an alkyl group or an aryl group, and X is a methoxy group, an ethoxy group or a halogen atom.

5. The electrophotographic photoreceptor described in the foregoing 4, wherein the number of the carbon atoms in the group represented by R in Formula 1 is from 4 to 8.

6. The electrophotographic photoreceptor described in any one of the foregoing 2 through 5, wherein at least one of the plural times of the surface treatments is a treatment by a compound selected from the group consisting of alumina, silica and zirconia.

7. The electrophotographic photoreceptor described in any one of the foregoing 1 through 6, wherein the N-type semiconductive particle is subjected to a surface treatment by an organic silicon compound having a fluorine atom.

8. The electrophotographic photoreceptor described in any one of the foregoing 1 through 7, wherein the N-type semiconductive particle has a number average primary particle diameter of from 10 nm to 200 nm.

9. The electrophotographic photoreceptor described in any one of the foregoing 1 through 8, wherein the N-type semiconductive particle is a metal oxide particle.

10. The electrophotographic photoreceptor described in the foregoing 9, wherein the N-type semiconductive particle is a titanium oxide particle.

11. The electrophotographic photoreceptor described in any one of the foregoing 1 through 10, wherein the binder of the interlayer is a polyamide resin.

12. The electrophotographic photoreceptor described in any one of the foregoing 1 through 11, wherein the interlayer has a dry thickness of from 0.2 to 15 $\mu$m.

13. An image forming method which the steps of charging, light exposing, developing by a toner and transferring are repeated by rotation of an electrophotographic photoreceptor, wherein the electrophotographic photoreceptor is the electrophotographic photoreceptor described in any one of the foregoing 1 through 12, and the toner to be used has a variation coefficient of the shape coefficient of not more than 16%, and a variation coefficient of the number particle diameter distribution of not more than 27%.

14. The image forming method described in the foregoing 13, wherein the toner contains toner particles each having a shape coefficient of from 1.0 to 1.6 in a ratio of not less than 65% in number.

15. The image forming method described in the foregoing 14, wherein the toner contains toner particles each having the shape coefficient of from 1.2 to 1.6 in a ratio of not less than 65% in number.

16. The image forming method described in any one of the foregoing 13 through 15, wherein the toner contains a toner particle having no corner in a ratio of not less than 50% in number.

17. The image forming method described in any one of the foregoing 13 through 16, wherein the toner has a number average diameter of from 3 to 8 $\mu$m.

18. The image forming method described in any one of the foregoing 13 through 17, wherein the sum M of a relative frequency of the toner particles included in the highest frequency class $m_1$ and a relative frequency of the toner particles included in the next high frequency class $m_2$ is not less than 70% in a histogram showing a particle diameter distribution in number which is classified into plural classes every 0.23 of natural logarithm ln D graduated on the horizontal axis of the histogram, where D is the diameter of the toner particle in $\mu$m.

19. The image forming method described in any one of the foregoing 13 through 18, wherein the toner comprises a colored particle produced by polymerizing a polymerizable monomer in an aqueous medium.

20. The image forming method described in any one of the foregoing 13 through 19, wherein the toner comprises a colored particle produced by associating polymer particles in an aqueous medium.

21. The image forming method described in any one of the foregoing 13 through 20, wherein the toner comprises a styrene acrylate resin or a styrene methacrylate resin.

22. An image forming apparatus using the image forming method described in any one of the foregoing 13 through 21.

23. A processing cartridge comprises the electrophotographic photoreceptor described in any one of the foregoing 1 through 12 and at least one of a charging means, a imagewise light exposing means, a developing means and a cleaning means combined into a unit so as to be freely put into and taken out from the image forming apparatus.

DETAILED DESCRIPTION OF THE INVENTION

Figure 1:
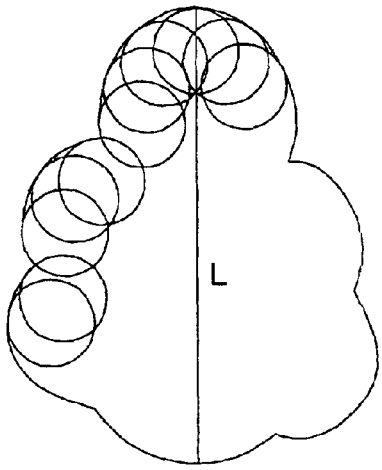
FIG. 1*a* shows a projected image of a toner particle having no corner and FIGS. 1*b* and 1*c* show each a projected image of a toner particle having a corner.
Figure 1:
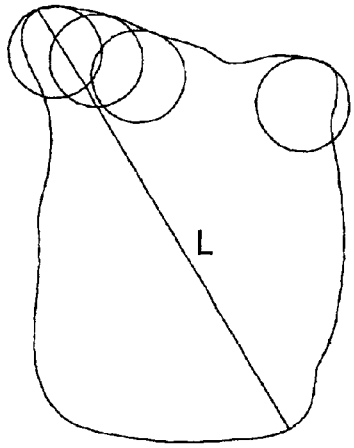
Figure 1:
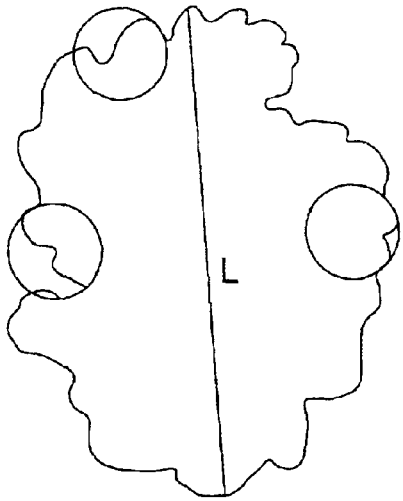

The invention is described in detailed below.

In the invention, "Benard cell" is a Benard cell or a convection current cell formed in a coated layer when the layer is coated. The cell structure is a surface state formed or partially formed by polygons formed by the occurrence of convection current of the ingredients of the coated layer in the vertical direction to the coated layer together with the effect of the surface tension in the course of drying of the coated layer of the dispersion for the interlayer to form the interlayer, namely in the course of solidifying of the coated layer by evaporation of the solvent contained in the coated layer of the dispersion for the interlayer.

The formation of the black spot can be inhibited by formation of the Benard cell on the surface of the interlayer containing the N-type semiconductive particle and the binder utilizing the convection current cell phenomenon at the time of the interlayer formation. The Benard cell means the surface state constituted or partially constituted by the polygons, and the layer having a surface state containing hexagons is preferred. The ratio of the number of the hexagon to the whole number of the polygon is preferably from 10 to 100%, more preferably from 20 to 100%. The size of the Benard cell is preferably from about 10 to 500 $\mu$m in the major length.

The size and the depth of the Benard cell in the interlayer according to the invention can be controlled by optionally selecting the viscosity, the surface tension, the kind and the composition of the solvent, the coated amount, the layer thickness, and the drying condition of the dispersion for the interlayer. The Benard cell easily can be formed when a surface-treated particle having a relatively large specific gravity such as a titanium oxide particle is used as the N-type semiconductive particle.

The use of the Interlayer Coating Liquid having a viscosity of from 7 to 250 c.p. is preferable to form the Benard cell. The convection current of the dispersion is easily occurred accompanied with the evaporation of the solvent in the coated layer when the viscosity of the dispersion is within such the range. When the viscosity of the dispersion is more than 250 c.p. or less than 7 c.p., the convection current of the dispersion in the coated layer in the course of solidification of the coated layer by the evaporation of the solvent contained in the coated layer is not occurred or the degree of the convection current is too low so that no Benard cell is possibly formed.

It is necessary to coat and dry the interlayer according to the invention so that the thickness of the dried layer is to be from 0.2 to 15 $\mu$m. The thickness of the dried layer is preferably from 0.3 to 10 $\mu$m, further preferably from 0.5 to 8 $\mu$m.

When the thickness of the dried layer is within the range of from 0.2 to 15 $\mu$m, the Benard cell can be easily formed at the surface since the difference of the surface tension and that of buoyancy at the surface and the bottom of the coated layer is sufficient, which functions as the driving force of the convection current of the ingredients of the coated layer occurred at the time of the solidification of the layer by the evaporation of the solvent contained in the coated layer.

Moreover, the uniform surface without occurrence of a foam and a crack can be easily formed since excessive drying by the compulsory drying after the solidification of the coated layer is inhibited when the dispersion had such the viscosity.

In the invention, the N-type semiconductive particle is a fine particle in which the electroconductive carrier is an electron. The property of the particle in which the electroconductive carrier is an electron is a property that the N-type semiconductive particle contained in the binder effectively blocks the hole injected from the support and does not block the electron from the photoreceptive layer.

The concrete example of the N-type semiconductive particle include a particle of titanium oxide $TiO_2$, zinc oxide $ZnO_2$ and tin oxide $SnO_2$, and titanium oxide is preferably used in the invention.

The average particle diameter of the N-type semiconductive particle to be used in the invention is preferably within the range of from 10 nm to 200 nm, more preferably from 15 nm to 150 nm, in the number average primary particle diameter. When the average particle diameter is less than 10 nm, no Benard cell is formed in the interlayer and the black spot preventing effect of the interlayer is low. When the average particle diameter is more than 200 nm, the uniformity of the Benard cells is degraded and the black spot is increased. The Interlayer Coating Liquid using the N-type semiconductive particle having the number average primary particle diameter within the foregoing range has high dispersion stability, and the interlayer formed by such the coating liquid, in which the Benard cells are formed, has a good environment suitability and an anti-clacking ability addition to the black spot preventing ability.

In the case of titanium oxide, the number average primary particle diameter of the N-type semiconductive particle is the value of the average diameter in the FERE direction determined by image analyzing on the randomly selected 100 particles which is magnified by 10,000 times by a transmission electron microscope.

The shape of titanium oxide includes a branched-shape, a needle-shape and a granule-shape. The crystal type of the titanium oxide particle having such the shapes includes an anatase-type, a rutile-type and an amorphous-type. Titanium oxide having any shape and any crystal type may be used, and a mixture of two or more kinds of titanium oxide each different from the other in the shape and the crystal type is also may be used.

In one of the surface treatments to be applied to the N-type semiconductive particle, plural times of treatments are applied and the last treatment of the plural treatments is carried out by the reactive organic silicon compound. It is preferred that at least on of the foregoing plural times of surface treatments is performed by the use of one or more kinds of compound selected from alumina $Al_2O_3$, silica $SiO_2$ and zirconia $ZrO_2$, and the surface treatment by the reactive organic silicon compound is performed at last. The above-mentioned compounds include a hydrated compound.

In another one of the surface treatments to be applied to the N-type semiconductive particle, plural times of treatments are applied and the last treatment is carried out by the use of a reactive organic titanium compound or a reactive organic zirconium compound. It is preferred that at least on of the foregoing plural times of surface treatments is carried out by the use of one or more kinds of compound selected from alumina, silica and zirconia, and the surface treatment by a reactive organic titanium compound or a reactive organic zirconium compound is performed at last.

The surface of the N-type semiconductive particle is uniformly covered by applying two or more times of the surface treatment as above-mentioned. The dispersibility of the N-type semiconductive particle in the interlayer is improved by the use of such the surface-treated N-type semiconductive particle in the interlayer and a suitable photoreceptor inhibited in the formation of image defect such as the black spot can be produced.

The N-type semiconductive particle treated by the use of alumina or silica and then treated by the reactive organic silicon compound and the N-type semiconductive particle treated by the use of alumina or silica and then treated by the reactive organic titanium compound or the reactive organic zirconium compound are particularly preferred.

It is particularly preferable that the treatment by alumina is firstly applied and then the treatment by silica is performed even though the foregoing treatments by alumina and silica may be applied simultaneously. The treating amount of silica is preferably larger than that of alumina when the treatment by alumina and that by silica are each applied.

The surface treatment of the N-type semiconductive particle by the metal oxide such as alumina, silica and zirconia may be performed by a wet method. For example, the N-type semiconductive particle surface-treated by silica or alumina can be prepared by the following procedure.

When titanium oxide particle is used as the N-type semiconductive particle, titanium oxide particles having a number average primary particle diameter of 50 nm were dispersed in water in a concentration of from 50 to 350 g to prepare aqueous slurry, and a water-soluble silicate or a water-soluble aluminum compound is added to the slurry. Then the slurry is neutralized by the addition of an alkali or an acid to precipitate silica or alumina onto the surface of the titanium oxide particles. Thereafter, the particles are filtered, washed and dried to prepare the subjected surface-treated titanium oxide. When sodium silicate is used as the forgoing water-soluble silicate, the slurry can be neutralized by an acid such as sulfuric acid, nitric acid and hydrochloric acid. On the other hand, when aluminum sulfate is used as the forgoing water-soluble aluminum compound, the slurry can be neutralized by an alkali such as sodium hydroxide and potassium hydroxide.

The amount of the metal oxide to be used in the surface-treatment is from 0.1 to 50 parts, preferably from 1 to 10 parts, by weight to 100 parts by weight of the N-type semiconductive particle such as titanium oxide in the charging amount at the time of the surface treatment. In the above-mentioned case using alumina and silica, it is preferable that alumina and silica are each used in an amount of from 1 to 10 parts by weight per 100 parts by weight of titanium oxide particles, and that the amount of silica is larger than that of alumina.

The surface treatment by the reactive organic silicon compound to be applied next to the surface treatment by the metal oxide is preferably performed by the following wet method.

The titanium oxide treated by the metal oxide is added to a liquid which is prepared by dissolving or suspending the reactive organic silicon compound in an organic solvent or water, and the mixture is stirred for a period of from several minutes to about one hour. The titanium oxide is filtrated and dried to prepare titanium oxide particles each covered with the organic silicon compound. In some cases, the mixture is heated before the filtration. The reactive organic silicon compound may be added to a suspension prepared by dispersing the titanium oxide particles in an organic solvent or water.

It is confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the reactive organic silicon compound.

The amount of the reactive organic silicon compound to be used for the surface treatment is preferably from 0.1 to 50, more preferably from 1 to 10, parts by weight per 100 parts by weight of the titanium oxide surface-treated by the metal oxide. Sufficient effect of the surface treatment can be obtained by the use of such the amount of the reactive organic silicon compound. Consequently, suitable dispersibility of the titanium oxide particles in the interlayer is obtained and no deterioration of the electric property of the photoreceptor such as increasing of the remained potential or decreasing of the charged potential is occurred.

The reactive organic silicon compound is a compound capable of condensation reacting with a hydroxyl group on the surface of the titanium oxide. Preferable examples of the compound are represented by the following Formula 2.

$$(R)_n—Si—(X)_{4-n} \qquad \text{Formula 2}$$

In the above, Si is a silicon atom, R is an organic group which is directly bonded to the silicon atom by the carbon atom thereof, X is a hydrolysable group and n is an integer of from 0 to 3.

Examples of the organic group represented by R which is directly bonded to the silicon atom by the carbon atom thereof include an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl)ethyl group; a (metha)acryloyl group-containing group such as a γ-acryloxypropyl group and a γ-methacryloxypropyl group; a hydroxyl group-containing group such as a γ-hydroxy propyl group and a 2,3-dihydroxypropyloxypropyl group; a vinyl group-containing group such as a vinyl group and a propenyl group; a mercapto group-containing group such as a γ-mercaptopropyl group; an amino group-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; and an alkyl group substituted by a nitro group or a cyano group. Examples of the hydrolysable group represented by X include an alkoxyl group such as a methoxy group and an ethoxy group; a halogen atom and an acyloxy group.

The organic silicon compounds represented by Formula 2 may be used singly or in combination.

In the compound represented by Formula 2, when n is 2 or plural groups represented by R may be the same or different from each other when n is 2 or more, and groups represented by X may be the same or different from each other. When two or more kinds of the compound are used, R and X may be the same or different from each other between the different compounds.

Examples of the compound in which n is 0 are as follows: tetrachlorosilane, diethoxydichlorosilane, tetramethoxysilane, phenoxy trichlorosilane, tetraacetoxysilame, tetraethoxysilane, tetraallyoxysilane, tetrapropoxysilane, tetrakis(2-methoxyethoxy)silane, tetrabutoxysilane, tetraphenoxysilane, tetrakis(2-ethylbutoxy)silane and tetrakis(2-ethylhexyloxy)silane.

Examples of the compound in which n is 1 are as follows: trichlorosilane, methyltrichlorosilane, vinyltrichlorosilane, ethyltrichlorosilane, allyltrichlorosilane, n-propyltrichlorosilane, n-butyltrichlorosilane, chloromethylmethotrimethoxysilane, mercaptomethyltrimethoxysilane, trimethoxyvinylsilane, ethyltrimethoxysilane, 3,3,4,4,5,5,6,6,6-nonafluorohexyltrichlorosilane, phenyltrichlorosilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminometyltrimethoxysilane, benzyltrichlorosilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allyaminopropyltrimethoxysilane, propyltriethoxysilane, hexyltritrimethoxysilane, 3-aminopropyltriethoxysilane, 3-methacryloxypropyltrimethoxysilane, bis(ethylmethylketoxime)methoxymethylsilane, octyltriethoxysilane and dodecyltriethoxysilane.

Examples of the compound in which n is 2 are as follows: dimethyldichlorosilane, dimethoxymethylsilane, dimethoxydimethylsilane, methyl-3,3,3-trifluoropropyldichlorosilane, diethoxysilane, diethoxymethylsilane, dimethoxymethyl-3,3,3-trifluoropropylsilane, chloromethyldiethoxysilane, diethoxydimethylsilane, dimethoxy-3-mercaptopropylmethylsilane, 3,3,4,4,5,5,6,6,6-nonafluorohexylmethyldichlorosilane, diacetoxymethylvinylsilane, diethoxymethylvinylsilane, 3-methacryloxypropylmethyldichlorosoilane,3-(2-aminoethyl-aminopropyl)dimethoxymethylsilane, t-butylphenyldichloro-silane, 3-methacryloxypropyldimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxyporopylthio)propyldimethoxymethylsilane, dimethoxymethyl-3-piperidinopropylsilane and diethoxymethyloctadecylsilane.

Examples of the compound in which n is 3 are as follows: trimethylchlorosilane, methoxytrimethylsilane, ethoxytrimethylsilane, methoxydimethyl-3,3,3-trifluoropropylsilane, 3-chloropropylmethoxydimethylsilane and methoxy-3-mercaptopropylmethylmethylsilane.

Preferable examples of the organic silicon compound represented by Formula 2 are represented by the following Formula 1.

$$R—Si—(X)_3 \qquad \text{Formula 1}$$

In the above, R is an alkyl group or an aryl group; and X is a methoxy group, an ethoxy group or a halogen atom.

R is preferably an alkyl group having from 4 to 8 carbon atoms. Examples of the preferable compound include trimethoxy-n-butylsilane, trimethoxy-i-butylsilane, trimethoxyhexylsilane and trimethoxyoctylsilane.

A hydrogenpolysiloxane compound is preferably used as the reactive organic silicon compound to be used in the last surface treatment. The hydrogenpolysiloxane having a molecular weight of from 1,000 to 20,000 is easily available and shows a suitable black spot inhibiting ability.

Particularly, good effect can be obtained when methylhydrogenpolysiloxane is used for the last surface treatment.

Another surface treatment for the titanium oxide is a treatment by an organic silicon compound having a fluorine atom. The treatment using the organic silicon compound having a fluorine atom is preferably applied by the following wet method.

The organic silicon compound having a fluorine atom is dissolved or suspended in an organic solvent or water and untreated titanium oxide particles are added therein. The liquid is mixed by stirring for a period of from several minutes to about 1 hour. Then the particles are filtered and dried. Thus the surface of each of the titanium oxide particles is covered by the organic silicon compound having a fluorine atom. In some cases, the mixture is heated before the filtration. The organic silicon compound having a fluorine atom may be added to the suspension comprising the organic solvent or water and the titanium oxide particles dispersed therein.

It is confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the organic silicon compound having a fluorine atom.

Examples of the organic silicon compound having a fluorine atom include 3,3,4,4,5,5,6,6,6-nonafluorohexyltrichlorosilane, 3,3,3-trifluoropropyltrimethoxysilane, methyl-3,3,3-trifluoropropyldichlorosilane, dimethoxymethyl-3,3,3-trifluoropropylsilane and 3,3,4,4,5,5,6,6,6-nonafluorohexylmethyldichlorosilane.

The interlayer containing the N-type semiconductive particle such as the titanium oxide particle treated on its surface, hereinafter referred to as the surface-treated N-type semiconductive particle and the titanium oxide particle treated on its surface is referred to as the surface-treated titanium oxide particle, is described below.

The interlayer is formed by coating a liquid comprising a solvent in which the surface-treated N-type semiconductive particles such as the surface-treated titanium oxide particles are dispersed together with a binder resin, on an electroconductive support.

The interlayer is provided between the electroconductive support and the photosensitive layer and has functions of suitably adhering with the electroconductive support and the photosensitive layer, suitably transfer an electron injected from the photosensitive layer to the electroconductive support and preventing the positive hole injection from the support as a barrier.

The resin binder usable in the interlayer includes a polyamide resin, a vinyl chloride resin, a vinyl acetate resin, a poly(vinyl acetal) resin, a poly(vinyl butyral) resin, a polyvinyl alcohol, a thermal hardenable resin such as a melamine resin, an epoxy resin and an alkyd resin, and a copolymer resin composed of two or more repeating units of the fore going resins. Among them, the polyamide resin is preferable and an alcohol-soluble polyamide such as an amide copolymer and a methoxymethylolized amide polymer is particularly preferable.

The amount of the surface-treated N-type semiconductive particle according to the invention to be dispersed in the binder is from 10 to 10,000 parts, preferably from 50 to 1,000 parts, by weight per 100 parts by weight of the binder resin in the case of the surface-treated titanium oxide. When the surface-treated titanium oxide is used in the foregoing amount, the dispersed status of the titanium oxide can be suitably maintained and a suitable interlayer without the formation of black spot can be formed.

The interlayer of the invention is substantially an insulating layer, the volume resistivity of which is from $1\times10^{8}$ to $1\times10^{15}$ Ωcm, preferably from $1\times10^{9}$ to $1\times10^{14}$ Ωcm and more preferably $2\times10^{9}$ to $1\times10^{13}$ Ωcm, in view of maintaining charge blocking ability, potential of photoreceptor and minimized residual potential whereby reduced generation of black spots and good image quality are obtained. The volume resistivity is measured by the following way.

The measurement condition: According to JIS C2318-1975

Instrument: Hiresta IP (manufactured by MITSUBISHI PETROCHEMICAL COMPANY, LTD.)

Condition: Measurement Probe HRS

Voltage applied: 500 V

Environment: 20±2° C., 65±5 RH%

An interlayer coating composition for forming the interlayer comprises the surface treated N-type semiconductive particle such as the surface-treated titanium oxide, the binder resin and a dispersing solvent. The dispersion solvent to be used for preparation of the photosensitive layer can be optionally used as the dispersing solvent.

Examples of the solvent or the dispersing medium to be used for preparing the interlayer, the photosensitive layer and another layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,1,2-trichloroethane, 1,1,1-trichloroethane, trichloroethylene, tetrachloroethane, tetrahydrofuran, dioxolane, dioxane, methanol, ethanol, butanol, iso-propanol, ethyl acetate, butyl acetate, dimethylsulfoxide and methyl cellosolve.

The solvent for the interlayer coating composition is not limited thereto. Among them, methanol, ethanol, 1-propanol and iso-propanol are preferably used. The solvents may be used singly or in combination.

A mixture of methanol having a high resin dissolving ability and a straight-chain alcohol is preferably used for the interlayer coating solvent to prevent the formation of drying unevenness. The preferable mixing ratio of the straight-chain alcohol to 1 of methanol by volume is from 0.05 to 0.6. The evaporation speed of the solvent is suitably maintained by the use of such the mixed solvent so as to prevent occurrence of the image defect caused by the drying unevenness.

Any dispersing means such as a sand mill, a ball mill and an ultrasonic disperser may be used for dispersing the surface-treated titanium oxide to prepare the interlayer coating composition.

A coating method such as an immersion coating, a spray coating and coating by a coating amount controlling circular coating means may be used for preparing the photoreceptor including the interlayer. The spray coating and the coating by the coating amount controlling circular coating means such as ring shaped slide hopper coating apparatus are preferably used so as to inhibit dissolution of the under layer as small as possible and to attain uniform coating when the photoreceptor is cylindrical. The spray coating method is described in JP O.P.I. Nos. 3-90250 and 3-269238 and the coating amount controlling circular coating means is described in JP O.P.I. No. 58-189061.

The photoreceptor preferably to be used in the invention is described below.

The resin layer can be applied to a photoreceptor having any photosensitive material such as inorganic or organic photosensitive material, and preferably it is applied to an organic photosensitive material.

The organic photosensitive material comprises at least one of charge generating function and charge transporting function, which include a photosensitive material composed of organic charge generating material or organic charge transporting material, or a photosensitive material composed of polymer chelate having charge generating function and organic charge transporting function.

The organic photoreceptor has preferably photosensitive layer such as charge generation layer and charge transporting layer or single layer having charge generation/charge transporting function and a resin layer provided on the photosensitive layer. The surface layer of the invention can be employed as the charge transfer layer since the surface layer possesses functions of a surface layer as well as a charge transfer layer.

The preferable photosensitive layer to be used in the electrographic photoreceptor according to the invention is described below.

Electroconductive Support

A cylindrical electroconductive support is preferably used to make compact the image forming apparatus even though a cylindrical and sheet-shaped support may either be used.

Images can be endlessly formed by the cylindrical electroconductive support. The electroconductive support having a straightness of not more than 0.1 mm and a swing width of not more than 0.1 mm is preferred.

The roughened surface of the conductive support employed in the present embodiment is preferably from 0.2 to 2.0 μm in terms of ten-point mean surface roughness Rz, and is more preferably from 0.3 to 1.8 μm in view of obtaining good adhesion and minimized image defects such as black spots.

As noted above, methods for roughening the surface of supports include a method which shaves the support surface employing cutting tools so as to achieve surface roughening, a sand blasting method in which minute particles are allowed to collide with the support surface, a machining method employing the ice particle washing apparatus described in Japanese Patent Publication Open to Public Inspection No. 4-204538, and a honing method described in Japanese Patent Publication Open to Public Inspection No. 8-15110. Further, listed are an anodic oxidation method, an alumite processing method, a buffing method, a method utilizing a laser method described in Japanese Patent Publication Open to Public Inspection No. 8-1502, and a roller burnishing method described in Japanese Patent Publication Open to Public Inspection No. 8-1510. The other surface roughening methods may also be employed.

Definition of Surface Roughness Rz and its Measurement Method

The surface roughness Rz, as describes in the present embodiments, refers to ten-point mean roughness of length L of 15 mm, that is, the difference between the average height of the 5 highest peaks and the average depth of the 5 lowest valleys. Rmax is a difference between the maximum highest peak and minimum lowest valley. Rmax is preferably from 0.2 to 3.0 μm In the present embodiments, roughness Rz and Rmax was determined employing a surface roughness meter (Surfcorder SE-30H, manufactured by Kosaka Kenkyusho Co.). The other measurement devices may be employed as long as the same results are obtained within the prescribed error range.

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

When the photoreceptor using a cylindrical electroconductive support having a diameter of from 10 to 50 mm is used, the processing means necessary to electrophotographic image formation such as the charging device, the image exposing device, the developing device, the transfer electrode and the cleaning device can be easily arranged around the photoreceptor and the electrophotographic image forming apparatus easily can be made compact. The diameter of the cylindrical support is preferably from 20 to 40 mm.

The conductive support can be a flexible belt. The present invention can be applied to a sheet belt shape photoreceptor. In an electrophotographic photoreceptor comprising an aluminum drum support and a photoreceptive layer provided on the aluminum support, which is most frequently used at the present time, provision of any electroconductive layer is not necessary since the drum support it self functions as the electroconductive layer. In the case of the photoreceptor using a flexible belt support, it is necessary to provide an electroconductive layer since such the support is non-electroconductive.

Example of the electroconductive layer includes one formed by spattering metal or metal oxide such as aluminum and indium tin oxide ITO and one formed by coating an electroconductive resin comprising an electroconductive fine particle such as ITO and alumina.

As the material of the belt-shaped photoreceptor support, a know engineering plastic base can be used without any limitation, for example, poly(ethylene terephthalate), poly (ethylene naphthalate), poly(etherimide), poly (ethersulfone), polycarbonate and polyarylate are usable. The support having a thickness of from 50 to 100 μm is used in view of the stiffness and the softness of the support. The electric resistively of the electroconductive layer is preferably not more than $10^3$ Ω·cm at an ordinary temperature.

Interlayer

In the present invention, an interlayer, functioning as a barrier, may be provided between the electrically conductive support and the photosensitive layer.

Photosensitive Layer

It is preferable that the photosensitive layer having a charge generation layer CGL and a charge transfer layer CTL separated from each other even though a single structure photosensitive layer having both of the charge generation function and the charge transfer function may be used. The increasing of the remaining potential accompanied with repetition of the use can be inhibited and another electrophotographic property can be suitably controlled by the separation the functions of the photosensitive layer into the charge generation and the charge transfer. In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

The photosensitive layer of the function separated negatively charged photoreceptor is described below.

Charge Generation Layer

Charge generation layer: the charge generation layer contains one or more kinds of charge generation material CGM. Another material such as a binder resin and additive may be contains according to necessity.

Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Concrete examples of such the CGM include a phthalocyanine pigment and a perylene pigment each having a specific crystal structure. For example, a titanyl phthalocyanine having the maximum peak of Bragg angle 2θ of Cu—Kα ray at 27.2° and a benzimidazoleperylene having the maximum peak of Bragg angle 2θ of Cu—Kα ray at 12.4° as the CGM are almost not deteriorated by the repetition of use and the increasing of the remaining potential is small.

A binder can be used in the charge generation layer as the dispersion medium of the CGM. Examples of the most preferable resin include a formal resin, a silicone resin, a silicon-modified butyral resin and a phenoxy resin. The ratio of the binder resin to the charge generation material is from 20 to 600 parts by weight to 100 parts by weight of the binder resin. By the use of such the resin, the increasing of the remaining potential accompanied with the repetition of use can be minimized. The thickness of the charge generation layer is preferably from 0.01 μm to 2 μm .

Charge Transfer Layer

Charge transfer layer: the charge transfer layer contains a charge transfer material CTM and a layer-formable binder resin in which the CTM is dispersed. An additive such as an antioxidant may be further contained according to necessity.

For example, a triphenylamine derivative, a hydrazone compound, a styryl compound, a benzyl compound and a butadiene compound may be used as the charge transfer material CTM. These charge transfer material are usually dissolved in a suitable binder resin to form a layer. Among them, the charge transfer materials capable of minimizing the increasing of the remaining potential accompanied with repetition of use is one having the difference of the ionization potential of such the CTM and that of the CGM to be used in combination with the CTM is preferably not more than 0.5 (eV), more preferably not more than 0.25 (eV).

The ionization potential of the CGM and CTM is measured by a surface analyzer AC-1, manufactured by Riken Keiki Co., Ltd.

Examples of the resin to be used for charge transfer layer CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

The polycarbonate resin is most preferable as the binder for CTL. The polycarbonate resin is most preferable since the resin simultaneously improves the anti-abrasion ability, the dispersing ability of the CTM and the electrophotographic property of the photoreceptor. The ratio of the binder resin to the charge transfer material is preferably from 10 to 200 parts by weight to 100 parts by weight of the binder resin, and the thickness of the charge transfer layer is preferably from 10 to 40 $\mu$m.

Surface Layer

The siloxane resin layer is provided as the surface layer of the photoreceptor according to the invention to obtain most preferable layer structure of the photoreceptor.

Although the most preferable layer constitution of the photosensitive layer according to the invention is described in the above, another layer constitution may be applied.

Described next will be the toner which is employed in the present invention.

Preferred as the toner of the present invention is a polymerized toner in which the size distribution of individual toner particles as well as their shape is relatively uniform. The polymerized toner as described herein means a toner obtained in such a manner that binder resins for the toner as well the shape of toner particles are formed by polymerization of monomers as the raw materials of the binder resins followed by chemical treatment. More specifically, said polymerized toner means the toner which is obtained by polymerization such as suspension polymerization, emulsion polymerization and the like, if desired, followed by a fusing process among particles which is carried out after said polymerization.

Preferred as the polymerized toner which is employed in the cleaning device employing the cleaning blade member of the present invention is one having a specific shape of toner particles. The polymerized toner, which may preferably be employed in the present invention, will be described below.

It is preferable to employ a toner having small variation coefficient of shape coefficient and small variation of particle diameter distribution for obtaining good image having enhanced image sharpness. The toner having such characteristics can reproduce fine dot image precisely and minimize the occurrence of filming which causes image defects such as black spots.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. In the present invention, it has been discovered that even though such a polymerized toner is employed, it is possible to stabilize the vibration of the cleaning blade member, and excellent cleaning performance is exhibited.

Investigation was carried out based on the aforementioned viewpoints. As a result, it has been discovered that by employing a toner having a variation coefficient of the toner shape coefficient of not more than 16 percent, as well as having a number variation coefficient in the toner number size distribution of not more than 27 percent, high image quality, which is exhibited by excellent cleaning properties, as well as excellent fine line reproduction, can be obtained over an extended period of time.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by Nihon Denshi Co. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The variation coefficient of the polymerized toner, which is preferably employed in the present invention, is calculated using the formula described below:

$$\text{Variation coefficient}=(S/K)\times 100\ \text{(in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The toner particles of the present invention, which substantially have no corners, as described herein, mean those having no projection to which charges are concentrated or which tend to be worn down by stress. Namely, as shown in FIG. 1(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 1(*b*) and 1(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Of methods to control the shape coefficient, the polymerized toner method is preferable since it is simple as well as convenient as a toner production method, the surface uniformity is excellent compared to pulverized toner, and the like.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

The water based medium as described in the present invention means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 1,000,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, fox example, Seizo Okamura, et al., "Kobunshi Kagaku (Polymer Chemistry) 17", 601 (1960) edited by Kobunshi Gakkai, and others. based on said publication, it is possible to obtain detailed critical coagulation concentration. Further, as another method, a specified salt is added to a targeted particle dispersion while varying the concentration of said salt; the ξ potential of the resultant dispersion is measured, and the critical coagulation concentration is also obtained as the concentration at which said ξ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention.

Reaction apparatuses, which are preferably employed in the present invention, will now be described.

Figure 2:
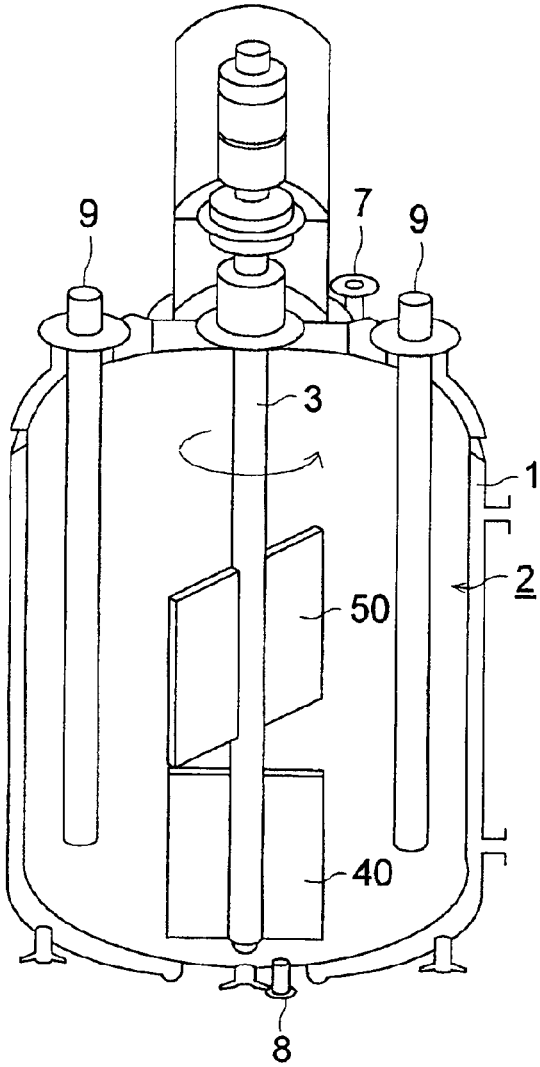
FIG. 2 is the oblique view of an example of a polymerization toner reaction vessel.
Figure 3:
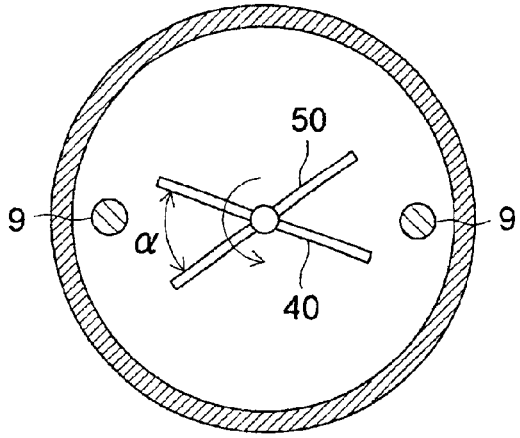
FIG. 3 is the cross section of an example of a polymerization toner reaction vessel.

FIGS. 2 and 3 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 2 and upper level stirring blade 50. The upper level stirring blades 50 are arranged with respect to the lower level stirring blade so as to have a crossed axis angle α advanced in the rotation direction. When the toner of the presents invention is prepared, said crossed axis angle α is preferably less than 90 degrees. The lower limit of said crossed axis angle α is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the configuration as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

Figure 4:
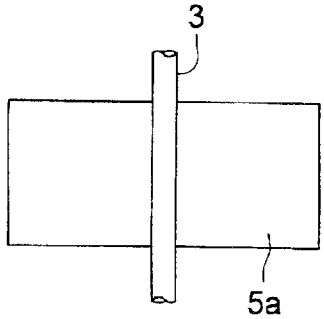
FIG. 4 is a schematic drawing showing the shape of a concrete example of stirring wings.
Figure 4:
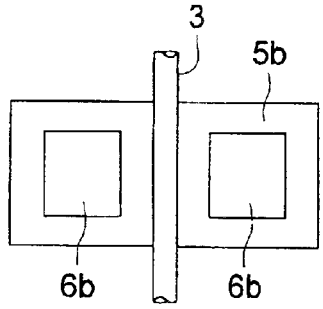
Figure 4:
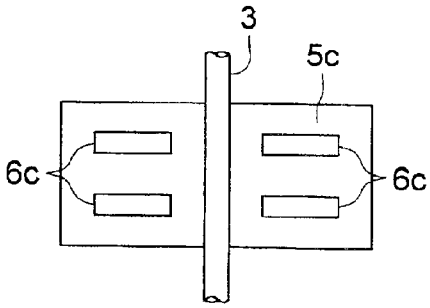
Figure 4:
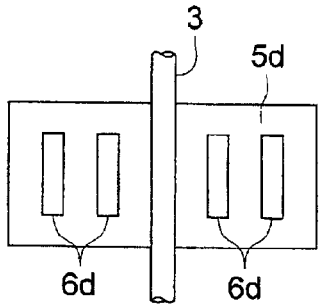
Figure 5:
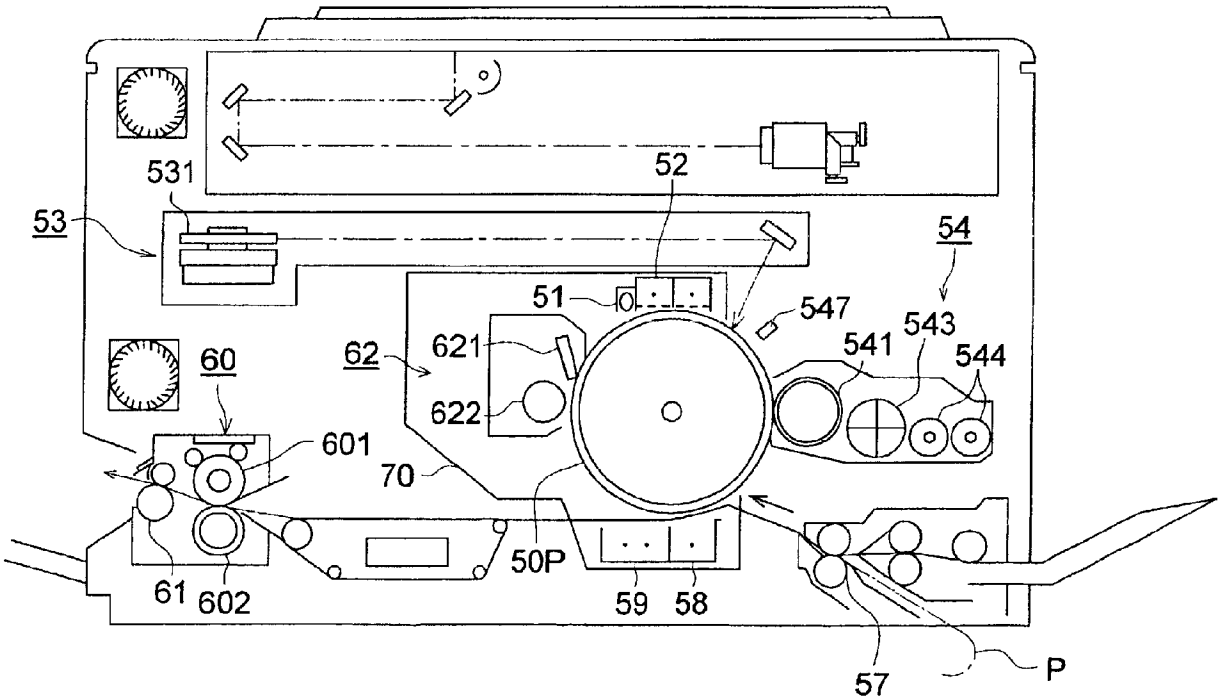
FIG. 5 is the cross section of an image forming apparatus as an example of the image forming method.

Arrows show the rotation direction, reference numeral 7 is upper material charging inlet, 8 is a lower material charging inlet, and 9 is a turbulent flow forming member which makes stirring more effective, in FIGS. 4 and 5.

Herein, the shape of the stirring blades is not particularly limited, but employed may be those which are in square plate shape, blades in which a part of them is cut off, blades having at least one opening in the central area, having a so-called slit, and the like. FIGS. 4(*a*) through 4(*d*) describe specific examples of the shape of said blades. Stirring blade 5*a* shown in FIG. 4(*a*) has no central opening; stirring blade 5*b* shown in FIG. 12(*b*) has large central opening areas 6*b*; stirring blade 5*c* shown in FIG. 4(*c*) has rectangular openings 6*c* (slits); and stirring blade 5*d* shown in FIG. 4(*d*) has oblong openings 6*d* shown in FIG. 4(*d*). Further, when stirring blades of a three-level configuration are installed, openings which are formed at the upper level stirring blade and the openings which are installed in the lower level may be different or the same.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed. Said apparatus is characterized in that obstacles such as a baffle plate and the like, which forms a turbulent flow, is not provided.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*c*), which are formed of a continuous plane are preferable, and those having a curved plane may also be employed.

Further, the toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by L1 ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

DEVELOPER

Toner according to the invention may be used as a single or double component developer. A double component developer is prepared by mixing a toner with a carrier.

Listed as single-component developers are a non-magnetic single-component developer, and a magnetic single-component developer in which magnetic particles having a diameter of 0.1 to 5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle size of said magnetic particles is preferably 15 to 100 $\mu$m, and is more preferably 25 to 60 $\mu$m .

The volume average particle size of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and any resins may be employed. For example, listed may be styrene-acryl based resins polyester resins, fluorine based resins, phenol resins, and the like.

The double component developer is prepared by mixing the toner and carrier. The concentration of the toner in the developer is to be between 2 and 10 percent by weight, and the resultant developer is employed.

Development methods according to the present invention are not particularly limited. A contact development method may be employed in which development is carried out in such a manner that the photoreceptor surface comes into contact with the developer layer, and a non-contact development method may also by employed in which the photoreceptor surface and the developer layer are maintained in a non-contact state, and development is carried out by allowing the toner jump in the space between the photoreceptor surface and the developer layer, employing means such as an alternating electrical field and the like.

FIG. 1 shows a cross section of an image forming apparatus as an example of the image forming method. In FIG. 1, 50 is a photoreceptor drum as an image carrier which is a drum coated with an organic photosensitive layer and further coated thereon with the resin layer according to the invention. The drum is grounded and driven so as to be rotated anticlockwise. The numeral 52 is a scorotron charging device which uniformly gives charge onto the surface of the photoreceptor drum 50 by corona discharge. In advance of the uniformly charging by the charging device (charging means) 52, the charge remained on the surface of the photoreceptor may be removed by light exposure by the means for exposing before charging 51 using a light source such as a light emission diode to remove the histolysis of the last image formation of the photoreceptor.

After the uniform charging, the photoreceptor is imagewise exposed to light by an image exposing device (exposing means) 53 according to the image information. The image exposing device 53 has a laser diode as the light source which is not shown in the drawing. The photoreceptor is scanned by a light beam turned through a rotating polygon mirror 531, an fθ lens and a reflecting mirror 532 so as to form a static latent image.

The surface of the photoreceptor is uniformly charged by charging device 52 and the imagewise exposed area is visualized by developing means in the reversal development. Unexposed area is not developed due to developing bias potential applied to development sleeve 541.

Then the static latent image is developed by a developing device (developing means) 54. The developing device 54 storing a developer comprised of a toner and a carrier is arrange around the photoreceptor 50P, and the development is performed by a developing sleeve 541 which has a magnet therein and is rotated while carrying the developer. The interior of the developing device is constituted by a developer stirring member 544, a developer conveying member 543 and a conveying amount controlling member 542, and the developer is stirred, conveyed and supplied to the developing sleeve. The supplying amount of the developer is controlled by the conveying amount controlling member 542. The conveyed amount of the developer is usually within the range of from 20 to 200 mg/cm$^2$ even though the amount is varied depending on the line speed of the organic electrophotographic photoreceptor and the specific gravity of the developer.

The developer comprises, for example, the carrier comprising of a ferrite core coated with a insulating resin, and a toner comprised of a colored particle comprising a styrene-acryl resin as a principal material, a colorant such as carbon black, a charge controlling agent and a low molecular weight polyolefin, and an external additive such as silica and titanium oxide. The developer is conveyed to the developing zone to occur the development while the thickness of the layer is regulated by the conveying amount controlling member. At the development a direct current bias, an alternative bias according to necessity, is usually applied between the photoreceptor drum 50P and the developing sleeve 541. The development is performed under a condition that the developer is touched or non-touched to the photoreceptor.

The recording paper P is supplied into the transferring zone by the rotation of a paper supplying roller 57 at when the timing for transfer is adjusted after the image formation.

In the transferring zone, the toner on the surface of the photoreceptor drum 50 is transferred to the supplied paper P by a transferring roller (transferring device) 58 which gives charge of opposite polarity to polarity of the toner.

Then the electric charge on the recording paper P is removed by a separating electrode (separating device) 59.

The recording paper P is separated from the surroundings of the photoreceptor drum 50 and conveyed to a fixing device 60. The toner image is melted and adhered onto the recording paper by heating and pressing by a heating roller 601 and a pressure roller 602 and the recording paper is output from the apparatus via exhausting roller 61. The transferring electrode 58 and the separating electrode 59 are released from the surface of the surface of the photoreceptor drum 50P after passing of the recording paper P to prepare the next image formation.

After separation of the recording paper P, the toner remaining of the photoreceptor drum 50P is removed by a blade 612 of a cleaning device (cleaning means) 62 pressed to the drum surface and the drum surface is cleaned. The photoreceptor is subjected to charge removing by the exposing device before charging 51 and the charging by the charging device 52 to progress into the next image forming process.

The numeral 70 shows a processing cartridge capable of being get into and off from the image forming apparatus in which the charging device, transferring device, the separating device and the cleaning device are arranged.

The constituent and the image formation process of the color image forming apparatus using the belt support according to the invention are described below referring to FIGS. 7 through 11.

In this apparatus, exposure to form a dot image is performed as to each of colors even though the incidence angle of the exposure is different according to the color.

Figure 7:
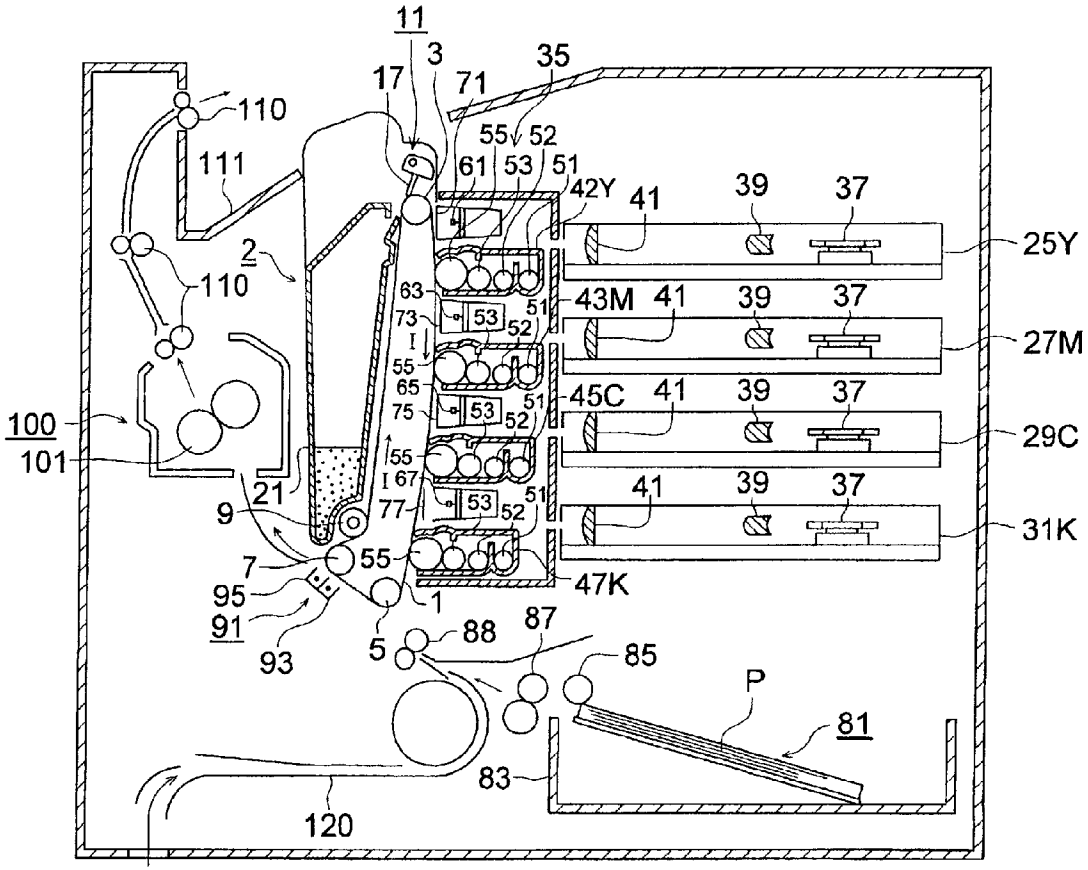
FIG. 7 is a drawing of the constitution of the image forming apparatus according to another embodiment of the invention.
Figure 8:
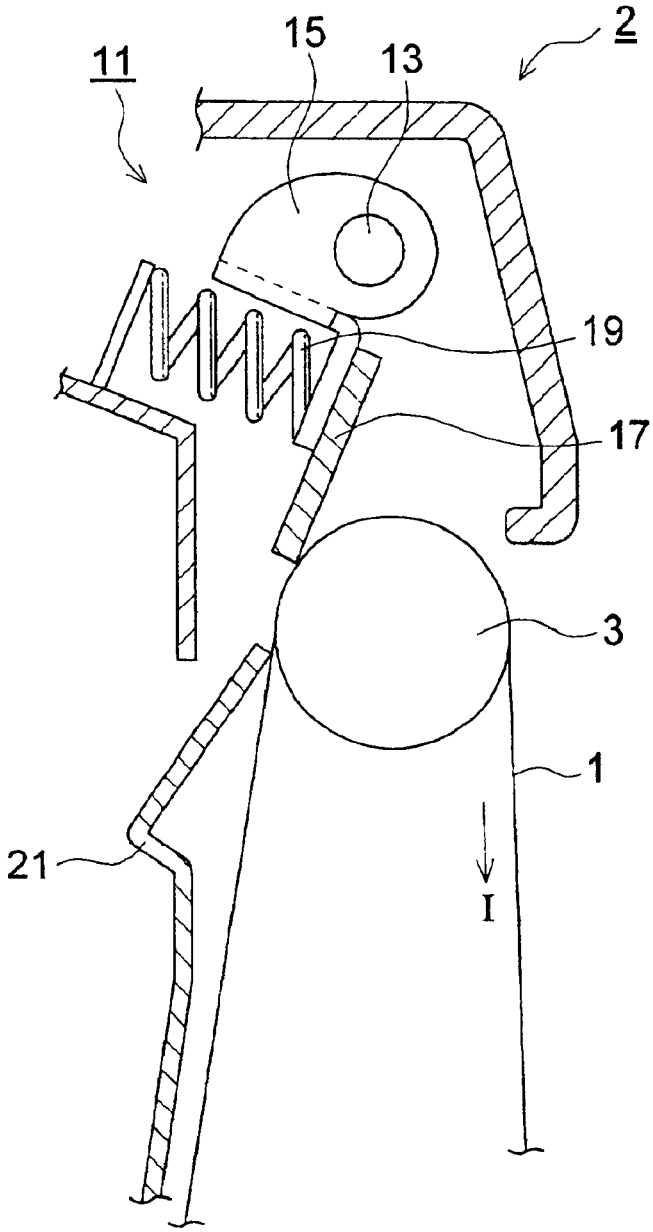
FIG. 8 is an enlarged drawing of the cleaning means in FIG. 7.
Figure 10:
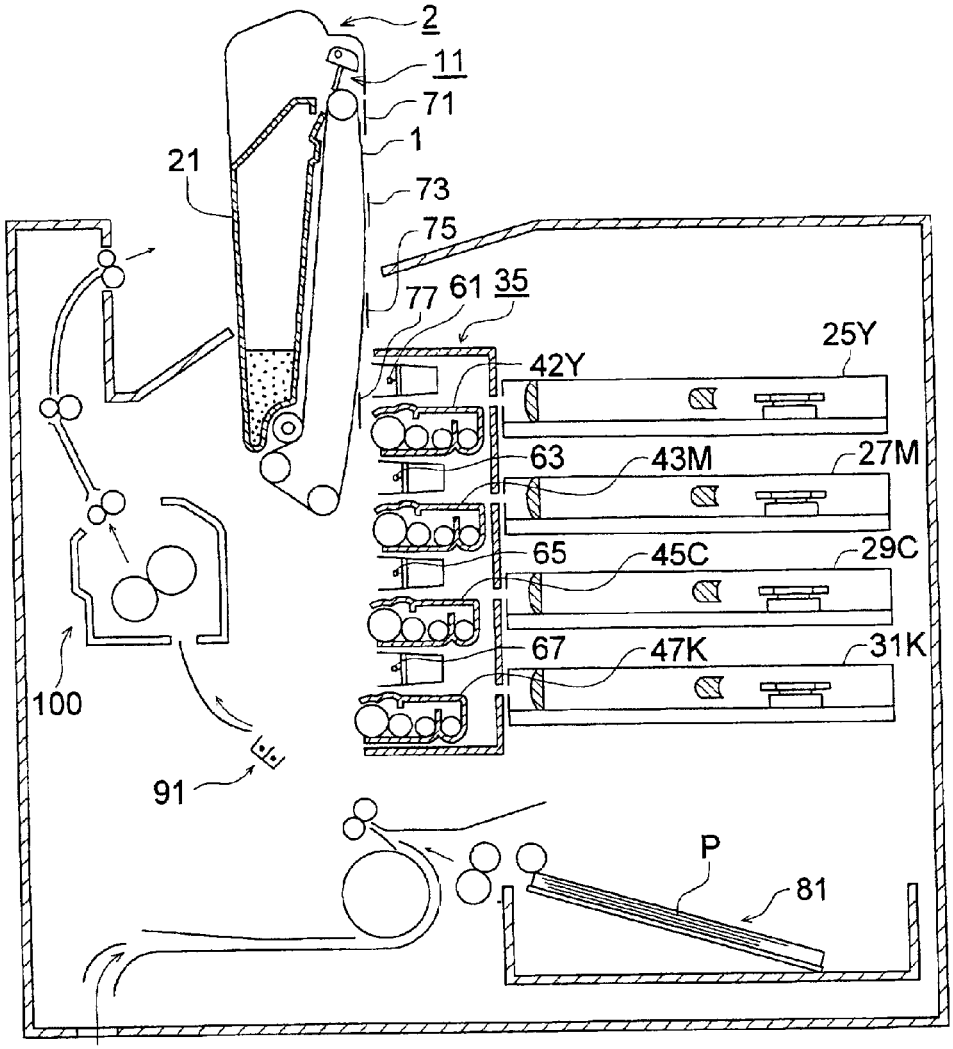
FIG. 10 is a structural drawing of the photoreceptor cartridge released from the image forming apparatus in FIG. 7.

First, the photoreceptor cartridge 2 is described, which is releasably installed in the image forming apparatus as shown in FIGS. 7 and 10. An endless belt-shaped photoreceptor 1 circulated by an upper roller 3, a lower roller 5 and a side roller 7 each as a tension roller, and a pressure roller 9 contacted to the photoreceptive surface, is suspended and strained by the upper roller 3 and the lower roller 5 and driven in the direction of the arrow I. The diameter of each of the rollers is 22 mm.

On the surface of the photoreceptor 1 moving upwards, the pressure roller 9 is provided as a means for guiding the photoreceptor 1 by pressing the photoreceptor 1 in the direction to the closed space formed by the photoreceptor 1.

At an upper position on the surface of the photoreceptor 1 moving upwards, a cleaning means 11 for removing the developer on the photoreceptor 1. The cleaning means 11 is described referring FIG. 8. A blade 17 capable of being contacted to the surface of the photoreceptor moving upward is provided on a bracket 15 which is rotatably provided on a shaft 13. The bracket 15 is pressed by a spring 19 so as to contact the blade 17 to the photoreceptor 1. One end of the spring 19 is fasten to the main body of the photoreceptor cartridge 2 and another end of the spring 9 is fasten to the bracket 15.

A recovery box 21 is provided along the photoreceptor 1 as a means for recovering the developer removed by the cleaning means 11.

Next, the method for forming a latent image on the photoreceptor 1 is described. The image forming apparatus of the example embodiment of the invention is a four color image forming apparatus; therefore the apparatus has four latent image forming means. The four latent image forming apparatus include Y optical writing device 25Y for forming a latent image for yellow image on the photoreceptor 1 using laser light, M optical writing device 27M for forming a latent image for magenta image on the photoreceptor 1 using laser light, C optical writing device 29C for forming a latent image for cyan image on the photoreceptor 1 using laser light, and K optical writing device 31K for forming a latent image for black image on the photoreceptor 1 using laser light.

Figure 9:
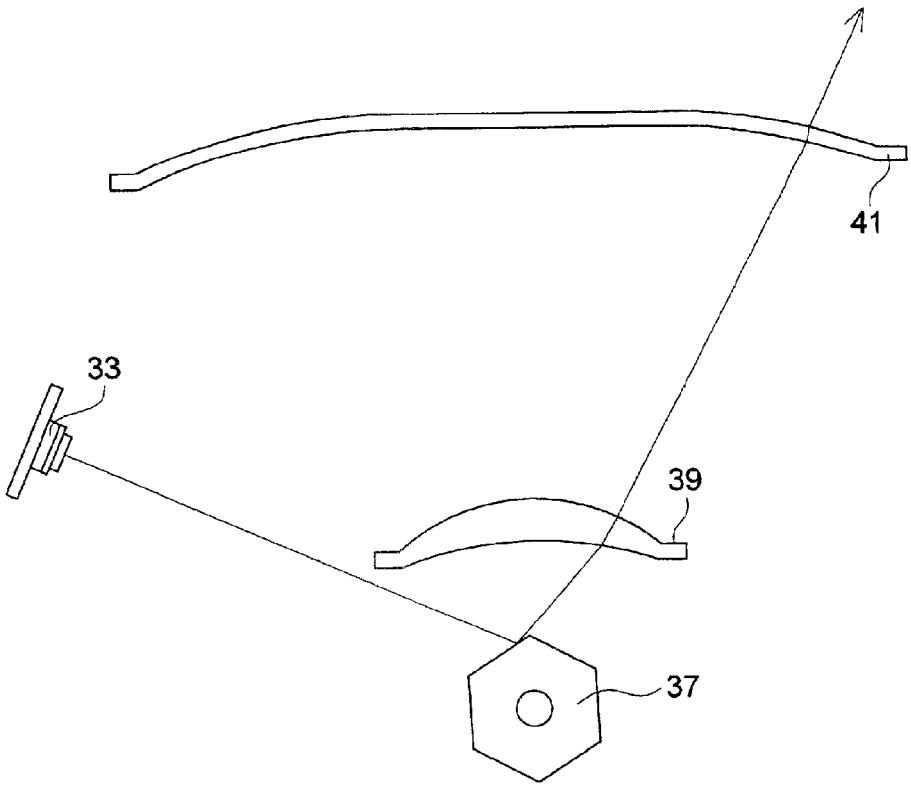
FIG. 9 is a plan view of the light writing means in FIG. 7.

Y optical writing device 25Y is described referring FIGS. 7 and 9. Description on the other writing devices is omitted since the structures of the four writing devices are the same. In these drawings, 33 is a laser light source for irradiating laser light modulated by the image information of Y. The laser light beam irradiated from the laser light source 33 is reflected by a polygon mirror 37 which is moved for scanning and scans the photoreceptive surface of the photoreceptor 1 through a fθ lens 39 and a cylindrical lens 41. A static latent image is formed on the photoreceptive surface of the photoreceptor 1 by the scanning light exposure.

Figure 11:
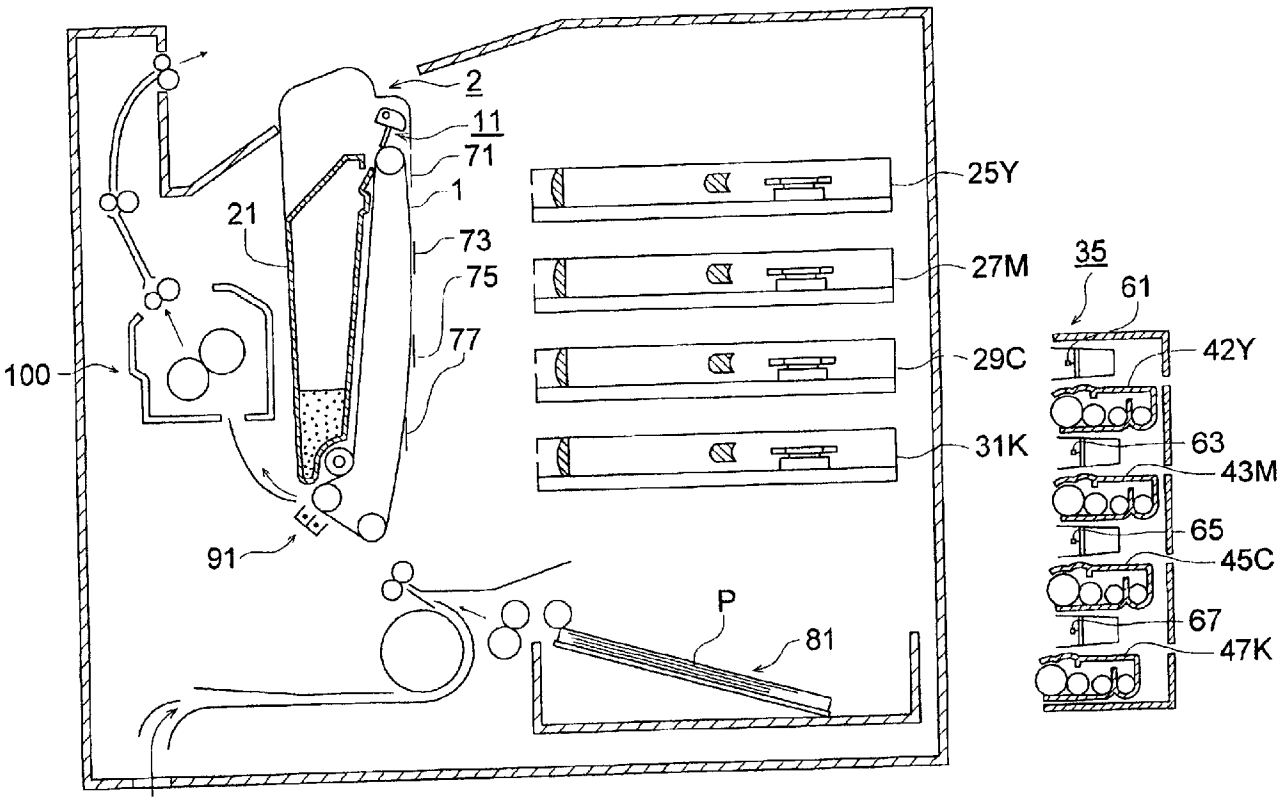
FIG. 11 is a structural drawing of the photoreceptor cartridge released from the image forming apparatus in FIG. 5.

An image forming cartridge 35 releasably provided in the image forming apparatus as shown in FIGS. 7 and 11 is described below. Four developing means for developing latent images of each of the colors formed on the photoreceptor 1 are provided in the image forming cartridge 35. Namely, the developing means are Y developing device 42Y for developing the latent image formed by the Y optical writing device 25Y, M developing device 43M for developing the latent image formed by the M optical writing device 27M, C developing device 45C for developing the latent image formed by the C optical writing device 45C, and K developing device 47K for developing the latent image formed by the K optical writing device 31K.

Y developing device 42Y is described. Description on the other developing devices is omitted since the structures of the four developing devices are the same. Screws 51 and 52 stirs and transports a developer for Y image supplied from a developer storage means which is not shown in the drawing; and a supplying roller 52 supplies the developer to a developing sleeve 55. The developer used in the embodiment of the example is a 2-component developer composed of a toner and a carrier. The developing sleeve 55 carries the developer and reversely develops the static latent image on the photoreceptor 1 to form a toner image on the photoreceptor 1.

Moreover, charging electrodes for giving static charge to the photoreceptor 1 are provided in the image forming cartridge 35 corresponding to the developing devices 42Y, 43M, 45C and 47K for each of the colors, namely, a charging electrode 61 for Y, a charging electrode 63 for M, a charging electrode 65 for C, and a charging electrode 67 for K.

In the embodiment of the example, the charging electrodes for each of the colors each have grids 71, 73, 75 and 77, respectively, for controlling the charge potential on the photoreceptor 1. The grids 71, 73, 75 and 77 are arranged at the side of the photoreceptor cartridge 2 as shown in FIG. 11.

In FIG. 7, 81 is a paper supplying means having a cassette 83 in which transfer paper P is stored. The transfer paper P in the cassette 83 is taken out by a conveying roller 85 and put and conveyed by a pair of conveying rollers 87 and a resist roller 88 to supply to a transferring means 91.

A transfer electrode 93 for transferring the toner image on the photoreceptor 1 onto the transfer paper P by corona discharge and a separation electrode 95 for separating the transfer paper P from the photoreceptor 1 by alternative current discharge are arranged in the transfer means 91.

In a fixing means 100, heat and pressure are applied by a pair of rollers 101 to the transfer paper P to fuse and adhere the toner to the transfer paper P. After the thermal fixation, the transfer paper P is conveyed by a pair of conveying rollers 110 to a takeout tray 111.

Transfer Paper having a different size supplied from a paper supplying means provided exterior of the apparatus is conveyed through a way 120.

The cation of the foregoing constituent is described below. The photoreceptor 1 is driven in the direction of the arrow I and the surface thereof is charged at a prescribed potential by the charging device for Y comprising charging electrode 61 and the grid 71.

A static latent image is formed on the photoreceptor 1 by the Y optical writing device. Then the toner contained in the developer carried on the developing sleeve 55 of the Y developing device 42Y is moved onto the photoreceptor 1 by Coulomb force so as to form a toner image on the photoreceptor 1.

The same procedure is carried out as to the other colors M, C and K to respectively form toner images of M, C and K on the photoreceptor 1.

Besides, a sheet of transfer paper P is conveyed from the paper supplying means 81 to the transferring means 91 by the conveying roller 85, the paired conveying rollers 87.

The supplied transfer paper P is conveyed synchronously with the toner image on the photoreceptor 1 after timing control by the register roller 88, and charged by the transfer electrode 93 of the transfer means 91 so as to transfer the toner image on the photoreceptor 1 onto the transfer paper 1.

The transfer paper P is separated from the photoreceptor 1 by the charge elimination function of the separation electrode 95. Then the transfer paper P is heated and pressed by the fixing means 100 so that the toner is fused and adhered onto the transfer paper P. Thereafter, the transfer paper is extruded on the takeout tray 111.

Excessive toner on the photoreceptor after the transfer is removed by the cleaning blade 17 of the cleaning means 11 and stored in the recovery box 21.

According to the foregoing structure of the image forming apparatus, simplification of the mechanism and miniaturization of the apparatus is made possible since the cleaning means 11 for removing the excessive toner on the photoreceptor 1 is arranged at the upper portion of the surface of the photoreceptor moving upward and the recovery box 21 for recovering the excessive toner is arranged at the under portion of the cleaning means so as to fall the removed toner into the recovery box by the gravity without use of any conveying means. Undesirable influence of the heat from the fixing device 100 to the photoreceptor 1 can be prevented by the cleaning means 11 and the recovery box 21 provided along the photoreceptor 1.

Moreover, the miniaturization of the apparatus can be attained by that the photoreceptor is bent by the pressure roller 9 in the direction to the closed space formed by the photoreceptor 1 and the recovery box 21 is arranged at the space formed by the bending of the photoreceptor 1.

The parts exchange can be simplified by providing the grids 71, 73, 75 and 77 each having a life almost the same with that of the photoreceptor 1 to the photoreceptor cartridge 2 since the photoreceptor 1 and the grids 71, 73, 75 and 77 can be exchanged at once.

Furthermore, the accuracy of distance between the grids 71, 73, 75 and 77 and the photoreceptor 1 can be constantly held by providing the grids 71, 73, 75 and 77 on the photoreceptor cartridge 2 for integrating the grids 71, 73, 75 and 77 and the photoreceptor 1. The high accuracy is required to the distance between the photoreceptor and the grid.

The parts exchange can be simplified by providing the charging electrode 61, 63, 65 and 67 each having a life almost the same with that of the developing devices 42Y, 43M, 45C and 47K to the image forming cartridge 35 since the photoreceptor and the charging electrodes can be exchanged at once.

The parts exchange can be simplified by providing each of the developing devices and each of the charging electrodes to the image forming cartridge 35 since the photoreceptor and the charging electrodes can be exchanged at once.

The invention is not limited to the foregoing exemplified embodiment. The invention can be applied to the monocolor image forming apparatus even though the foregoing description is regarding to the poly-color image forming apparatus.

The electrophotographic photoreceptor is suitable for an electrophotographic apparatus such as an electrophotographic copy machine, a laser printer, a LED printer, and further widely can be utilized to various apparatus for displaying, recording, short-run printing, and plate making and facsimile.

EXAMPLES

The invention is described in detail referring examples. In the examples, "part" is "part in weigh".

Dispersions for interlayer for the examples of the invention and the comparative examples were prepared as follows.

| Preparation of Interlayer Coating Liquid 1 | |
|---|---|
| Polyamide resin CM8000 (Toray Co., Ltd.) | 1 part |
| Titanium oxide SMT500SAS (TAYCA Corporation; surface treated by silica treatment, alumina treatment and methylhydrogenpolysiloxane treatment) | 3 parts |
| Methanol | 10 parts |

The above mixture was dispersed by a sand mill for 10 hours by a butch system to prepare Interlayer Coating Liquid 1.

Preparation of Interlayer Dispersions 2 through 7

Interlayer Dispersions 2 through 7 were prepared in the same manner as in Interlayer Coating Liquid 1 except that the titanium oxide, and its surface treatment, particle diameter and the solvent were changes as shown in Table 2.

Preparation of Interlayer Coating Liquid 8 (Comparative Example)

Interlayer Coating Liquid 8 was prepared by dissolving 1 part of polyamide resin CM8000, manufactured by Toray Co., Ltd., in a mixed solvent composed of 7 parts of methanol and 3 parts of 1-propanol.

Preparation of Interlayer Coating Liquid 9 (Comparative Example)

Interlayer Coating Liquid 9 was prepared in the same manner as in Interlayer Coating Liquid 1 except that the titanium oxide particle is replaced by a silica particle Aerosil R805, manufactured by Texa Co., Ltd., which is not N-type semiconductive particle.

Preparation of Photoreceptor 1

The following Interlayer Coating Liquid 1 was prepared in the following manner and coated by a immersion coating method on a cylindrical aluminum support having a diameter of 30 mm to form an interlayer 1 having a thickness of 2 $\mu$m . In the invention, the drying of the coated layer was slowly performed by low temperature drying so as to stably and easily form the Benard cell. The drying was performed at 60° C. for 10 minutes and then at 40° C. for 30 minutes.

The volume resistively of the dried interlayer after was $2\times10^{10}$ Ω·cm under the foregoing measuring condition.

<Interlayer (UCL) Coating Liquid 1>

Interlayer Coating Liquid 1 was diluted by 2 times by the same solvent and filtered after standing for one night using a rigimesh filter with a nominal filtering accuracy of 5 μm, manufactured by NIHON PALL LTD., with a pressure of $5\times10^4$ Pa.

The following coating liquid was mixed and dispersed by the sand mill to prepare a charge generation layer coating liquid. The coating liquid was coated by the immersion coating method on the foregoing inter layer to form a charge generation layer having a dry thickness of 0.3 μm.

| <Charge generation layer (CGL) Coating Liquid> | |
|---|---|
| Y-type titanylphthalocyanine (the maximum peak angle 2θ of 27.3° of X-ray diffraction measured by Cu-Kα characteristic X-ray) | 20 g |
| Poly(vinyl butyral) #6000-c (Denkikagaku Kogyo Co., Ltd.) | 10 g |
| t-Butyl acetate | 700 g |
| 4-methoxy-4-methyl-2-pantanone | 300 g |

The following coating liquid was mixed and dissolved to prepare a charge transport layer coating liquid. The coating liquid was coated by the immersion method on the foregoing charge generation layer so as to form a charge transport layer having a dry thickness of 24 μm. Thus Photoreceptor 1 was prepared.

| <Charge transport layer (CGL) Coating Liquid> | |
|---|---|
| Charge transport agent: 4-(2,2-diphenylvinyl)phenyl-di-p-tolylamine | 75 g |
| Polycarbonate resin Upiron Z3000 (Mitsubishi Gas Kagaku Co., Ltd.) | 100 g |
| Methylene chloride | 750 g |

Preparation of Photoreceptors 2 through 9

Interlayer Coating Liquids 2 through 9 were prepared in the same manner as in Interlayer Coating Liquid 1 except that Interlayer Coating Liquid 1 was replaced by each of Interlayer Dispersions 2 through 9, respectively. Photoreceptors 2 through 9 were prepared in the same manner as in Photoreceptor 1 except that Interlayer Coating Liquids 2 through 9 were each used, respectively, in the place of Interlayer Coating Liquid 1. The drying condition was the same as that in the preparation of Photoreceptor 1.

Photoreceptors 21 through 24 were prepared in the same manner as in Photoreceptor 1 except that Interlayer Coating Liquids 3 through 6 were each used, respectively, in the place of Interlayer Coating Liquid 1 and the diameter of the cylindrical aluminum support was changed as shown in Table 3. The drying condition was the same as that in the preparation of Photoreceptor 1.

The volume resistivity of dried Interlayers 2 through 9 were within the range of from $0.5\times10^{10}$ Ω·cm to $6\times10^{10}$ Ω·cm under the foregoing measuring condition.

Photoreceptor 10

Photoreceptor 10 having Interlayer 10 was prepared in the same manner as in Photoreceptor 1 except that an aluminum support subjected to anodizing and sealing treatments. The drying condition was the same as in the preparation of Photoreceptor 1.

The contents of each of the interlayer were described in Table 1 together with the evaluation on the formation of Benard cell.

Figure 6:
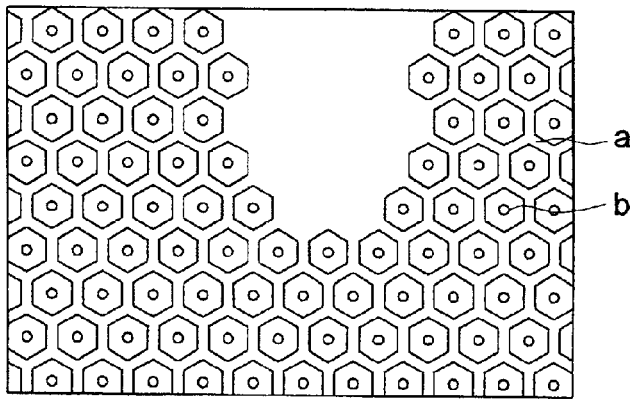
FIG. 6 shows the state of the Benard cell structure in which many polygons are formed in the entire direction on the plane.

The surface of the interlayer was observed by a scanning electron microscope with a magnitude of 200 times to confirm that many polygonal dents having the shape shown in FIG. 6 are formed in entire direction on the plane (Benard cell structure), and the state of the formation of the Benard cell was evaluated according to the following norm. In FIG. 6, A is a dent with the shape like the pattern of the shell of a tortoise and B is a dent with a spot like shape.

A: Polygonal dents having the length of the major axis of from 20 to 200 μm are formed on 50% or more of the surface of the interlayer.

B: Polygonal dents having the length of the major axis of from 20 to 200 μm are formed on from 10 to 49% of the surface of the interlayer.

C: Polygonal dents having the length of the major axis of from 20 to 200 μm are formed on less than 10% of the surface of the interlayer.

D: Polygonal dents having the length of the major axis of from 20 to 200 μm are not formed on the surface of the interlayer.

TABLE 1

| | | | Composition of interlayer coating liquid | | | | | Evaluation |
|---|---|---|---|---|---|---|---|---|
| *1 | *2 | *3 | Particle | Primary treatment | Secondary treatment | *7 | Solvent | of interlayer |
| 1 | 30 | 1 | SMT500SAS (TAYCA Co., Ltd.) | *4 | *5 | 35 | Methanol | A |
| 2 | 30 | 2 | SMT500SAS treated by phenylsilane | *4 | Phenyltrimethoxysilane | 35 | Methanol | A |
| 3 | 30 | 3 | SMT500SAS treated by methylsilane | *4 | Methyltrimethoxysilane | 40 | Methanol | A |
| 4 | 30 | 4 | SMT500SAS treated by octylsilane | *4 | Octyltrimethoxysilane | 35 | Methanol | A |
| 5 | 30 | 5 | SMT500SAS treated by hexylsilane | *4 | Trimethoxyhexylsilane | 40 | Methanol | A |
| 6 | 30 | 6 | MT500HS (TAYCA Co., Ltd.) | Alumina | *5 | 35 | *8 | A |
| 7 | 30 | 7 | MT500B treated by fluorinated silane | *4 | *6 | 35 | Methanol | B |
| 8 | 30 | 8 | — | — | — | — | *9 | D |
| 9 | 30 | 9 | Silica particle | Octylsilane | — | 15 | Methanol | C |

TABLE 1-continued

| | | | Composition of interlayer coating liquid | | | | | Evaluation |
|---|---|---|---|---|---|---|---|---|
| *1 | *2 | *3 | Particle | Primary treatment | Secondary treatment | *7 | Solvent | of interlayer |
| | | | (Aerosil R805) | | | | | |
| 10 | 30 | 1 | SMT500SAS (TAYCA Co., Ltd.) | *4 | *5 | 35 | Methanol | A |
| 11 | 40 | 3 | SMT500SAS treated by methylsilane | *4 | Methyltrimethoxysilane | 40 | Methanol | A |
| 12 | 50 | 4 | SMT500SAS treated by octylsilane | *4 | Octyltrimethoxysilane | 35 | Methanol | A |
| 13 | 20 | 5 | SMT500SAS treated by hexylsilane | *4 | Trimethoxyhexylsilane | 40 | Methanol | A |
| 14 | 15 | 6 | MT500HS (TAYCA Co., Ltd.) | Alumina | *5 | 35 | *8 | A |

*1 Photoreceptor and interlayer No.
*2 Diameter of aluminum substrate
*3 Interlayer Coating Liquid No.
*4 Silica · alumina
*5 Methylhydrogenpolysiloxane
*6 Fluoromethyltrimethoxysilane
*7 Number average primary particle (nm)
*8 Methanol/butanol (4/1)
*9 Methanol/1-prpanol (7/3)

Compounds described in a column of "Primary treatment" are those deposited on the surface of titanium oxide after primary treatment and the compounds described in a column of "Secondary treatment" are those employed in the secondary treatment in Table 1.

Production of Toners 1-1 through 1-5 (Example of Emulsion Polymerization Method)

Added to 10.0 liters of deionized water was 0.90 kg of sodium n-dodecyl sulfate, which was dissolved while stirring. Gradually added to the resultant solution were 1.20 kg of Regal 330R (carbon black, manufactured by Cabot Co.), and stirred well for one hour. Thereafter, the resultant mixture was continuously dispersed for 20 hours, employing a sand grinder (a medium type homogenizer). The resultant dispersion was designated as "Colored Dispersion 1". Further, a solution comprised of 0.055 kg of sodium dodecylbenzenesulfonate and 4.0 liters of deionized water was designated as "Anionic Surface Active Agent Solution A".

A solution comprised of 0.014 kg of nonyl phenyl polyethylene oxide 10-mole addition product and 4.0 liters of deionized water was designated as "Nonionic Surface Active Solution B". A solution prepared by dissolving 223.8 g of potassium persulfate in 12.0 liters of deionized water was designated as "Initiator Solution C".

Placed into a 100-liter GL (glass lining) reaction tank, fitted with a thermal sensor, a cooling pipe, and a nitrogen gas introducing device, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution A", and all of "Nonionic Surface Active Agent B", and the resultant mixture was stirred. Stirring blade shown by FIG. 4(*c*) was employed. Subsequently, 44.0 liters of deionized water were added.

When the mixture was heated to 75° C., all of "Initiator Solution C" was added dropwise. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added dropwise. After finishing dropwise addition, the mixture was heated to 80±1° C. and stirred for 6 hours while being heated. Subsequently the resultant mixture was cooled to not more than 40° C., and stirring was terminated. Said mixture was filtered employing a pole filter and the resultant filtrate was designated as "Latex (1)-A".

Incidentally, the glass transition temperature of resinous particles in Latex (1)-A was 57° C., and the softening point of the same was 121° C. The molecular weight distribution of the same exhibited parameters such as a weight average molecular weight of 12,700 and a weight average particle diameter of 120 nm.

Further, a solution, prepared by dissolving 0.055 kg of sodium dodecylbenzene sulfonate in 4.0 liters of deionized water, was designated as "Anionic Surface Active Agent Solution D". Still further, a solution prepared by dissolving 0.014 kg of nonyl phenol polyethylene oxide 10-mole added product in 4.0 liters of deionized water was designated as "Nonionic Surface Active Agent Solution E".

A solution, prepared by dissolving 200.7 g of potassium persulfate (manufactured by Kanto Kagaku Co.) in 12.0 liters of deionized water, was designated as "Initiator Solution F".

Placed into a 100-liter GL reaction tank, fitted with a thermal sensor, a cooling pipe, a nitrogen gas introducing device, and a comb-shaped baffle, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution D", and all of "Nonionic Surface Active Agent E", and the resultant mixture was stirred. Subsequently, 44.0 liters of deionized water were added. When the mixture was heated to 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. Thereafter, while maintaining the temperature of the mixture at 72±2° C., stirring was carried out for 6 hours while being heated. The temperature was further raised to 80±2° C., and stirring was carried out for 12 hours while being heated. The resultant solution was cooled to not more than 40° C., and stirring was terminated. Filtration was carried out employing a pole filter, and the resultant filtrate was designated as "Latex (1)-B.

The glass transition temperature of resinous particles in Latex (1)-B was 58° C., and the softening point of the same was 132° C. The molecular weight distribution of the same exhibited parameters such as a weight average molecular weight of 245,000 and a weight average particle diameter of 110 nm.

A solution, prepared by dissolving 5.36 kg of sodium chloride as the salting-out agent in 20.0 liters of deionized water, was designated as "Sodium Chloride Solution G".

A solution, prepared by dissolving 1.00 g of a fluorine based nonionic surface active agent in 1.00 liter of deionized water, was designated as "Nonionic Surface Active Agent Solution H".

Placed into a 100-liter SUS reaction tank, fitted with a thermal sensor, a cooling pipe, a nitrogen gas introducing device, and a particle diameter and shape monitoring device, the stirring blade being shown by FIG. 4(*c*), were 20.0 kg of Latex (1)-A and 5.2 kg of Latex (1)-B prepared as described above, 0.4 kg of colorant dispersion, and 20.0 kg of deionized water and the resultant mixture was stirred. Subsequently, said mixture was heated at 40° C., which was added to Sodium Chloride Solution G, 6.00 kg of isopropanol (manufactured by Kanto Kagaku Co.) and Nonionic Surface Active Agent Solution H in said order. Thereafter, the mixture was set aside for 10 minutes and then heated to 85° C. over 60 minutes. At 85±2° C., the mixture was stirred from 0.5 to 3 hours, so that the particle diameter increased under salting-out/fusion. Subsequently, 2.1 liters of pure water was added, to terminate the increase in the particle diameter.

Placed into a 5-liter reaction vessel, fitted with a thermal sensor, a cooling pipe, and a particle diameter and shape monitoring device were 5.0 kg of the fused particle dispersion prepared as described above, and the shape was controlled while stirring at the dispersion temperature of 85±2° C. from 0.5 to 15 hours. Thereafter, the resultant dispersion was cooled to not more than 40° C. and stirring was terminated. Subsequently, classification was carried out in the suspension by a centrifugal sedimentation method employing a centrifuge, and the resultant mixture was filtered employing a 45 μm opening sieve. The resultant filtrate was designated as Association Liquid (1). Subsequently, wet cake-like non-spherical particles were collected from said Association Liquid (1) through filtration, employing Buchner funnel and then washed with deionized water.

The resultant non-spherical particles were dried employing a flash jet drier at an intake air temperature of 600° C., and subsequently dried at 60° C., employing a fluidized-bed dryer. Externally blended with 100 parts, by weight, of the obtained colored particles were one part by weight of fine silica particles and 0.1 part by weight of zinc stearate, employing a Henschel mixer, and thus toners shown in the table below were obtained which were prepared employing the emulsion polymerization association method.

Toners 1-1 through 1-5 shown in Table 2 were prepared; the shape and the variation coefficient shape coefficient were controlled by controlling of the rotation number of the stirring wing and the heating time of the liquid temperature and the particle diameter and the variation coefficient of the particle diameter distribution were optionally controlled by classifying in the liquid at the salting out/melt-adhering step and the shape controlling step. The composition of the resin was styrene/n-butyl acrylate/acrylic acid in a mole ratio of 0.758/0.126/0.80. The Tg of the resin was 57° C.

Preparation of Toner 2-1 (Example of Emulsion Polymerization Method)

Toner 2-1 shown in Table 2 was prepared; the shape and the variation coefficient were controlled by controlling of the rotation number of the stirring wing and the heating time of the liquid temperature and the particle diameter and the variation coefficient of the particle diameter distribution were optionally controlled by classifying in the liquid by monitoring at the salting out/melt-adhering step and the shape controlling step the same manner as in Toner 1-1. The composition of the resin was changed from styrene/n-butyl acrylate/acrylic acid in a mole ratio of 0.758/0.126/0.80 in Toner 1-1 to styrene/n-butyl acrylate/n-butyl methacrylate in a mole ratio of 0.87/0.35/0.95. The Tg of the resin was 67° C.

Preparation of Toners 3-1 and 3-2

Toners 3-1 and 3-2 were prepared; the shape and the variation coefficient were controlled by controlling of the rotation number of the stirring propeller and the heating time of the liquid temperature and the particle diameter and the variation coefficient of the particle diameter distribution were optionally controlled by classifying in the liquid by monitoring at the salting out/melt-adhering step and the shape controlling step the same manner as in Toner 1-1. The composition of the resin was styrene/n-butyl acrylate/n-butyl methacrylate in a mole ratio of 0.67/0.03/0.30.

TABLE 2

| Kind of Toner | Variation coefficient of shape coefficient (%) | Number variation coefficient of particle diameter distribution (%) | Ratio of particle having a shape coefficient from 1.0 to 1.6 (%) | Ratio of particle having a shape coefficient from 1.2 to 1.6 (%) | Ratio of particle having no corner (%) | Number average particle diameter (μm) | The sum M of $m_1$ to $m_2$ |
|---|---|---|---|---|---|---|---|
| Toner 1-1 | 12.1 | 20.7 | 91.2 | 73.2 | 94 | 5.6 | 82.3 |
| Toner 1-2 | 15.6 | 26.8 | 78.2 | 63.2 | 88 | 3.6 | 85.9 |
| Toner 1-3 | 15.1 | 25.9 | 85.3 | 55.9 | 92 | 5.5 | 84.1 |
| Toner 1-4 | 14.2 | 22.1 | 76.9 | 56.8 | 85 | 7.1 | 80.4 |
| Toner 1-5 | 17.3 | 28.1 | 79.1 | 55.9 | 88 | 5.9 | 79.4 |
| Toner 2-1 | 14.3 | 23.8 | 89.4 | 70.6 | 92 | 4.9 | 80.3 |
| Toner 3-1 | 15.3 | 25.5 | 80.0 | 66.3 | 54 | 6.3 | 75.1 |

TABLE 2-continued

| Kind of Toner | Variation coefficient of shape coefficient (%) | Number variation coefficient of particle diameter distribution (%) | Ratio of particle having a shape coefficient from 1.0 to 1.6 (%) | Ratio of particle having a shape coefficient from 1.2 to 1.6 (%) | Ratio of particle having no corner (%) | Number average particle diameter (μm) | The sum M of $m_1$ to $m_2$ |
|---|---|---|---|---|---|---|---|
| Toner 3-2 | 17.7 | 29.1 | 63.0 | 58.7 | 44 | 7.6 | 66.8 |

Preparation of Developer

Eight kinds of developer, Developers 1-1 through 3-2, were prepared by mixing each of Toners 1-1 through 3-2, respectively, with a ferrite 45 μm carrier coated by a styrene-methacrylate copolymer in a ratio of 19.8 g of the toner to 200.2 g of the carrier.

Evaluation 2 (Image Evaluation)

Reversal development was performed for the evaluation using an image forming apparatus having means for charging, imagewise light exposing, transferring, fixing and cleaning as show in FIG. 5, in which a cylindrical photoreceptor having a diameter of from 10 to 50 mm could be installed. The image forming conditions, the charging condition and the cleaning condition, were as follows. The combinations of the photoreceptor and the toner subjected to the evaluation, Examples 1 through 10 and Comparative examples 1 and 2, are shown in Table 3.

Charging Condition

Charging device: Initial charging potential of −650 V

Developing Condition

DC bias: Approximately −500 V

Regulation on developer layer: Magnetic H-Cut method

Developing sleeve diameter: 40 mm

Transfer electrode: Corona charge method, transfer dummy current: 45 μA

Cleaning Condition

Elastic rubber blade: free length: 9 mm, thickness: 2 mm, hardness: 70°, elasticity: 35, contacting pressure to photoreceptor (line pressure): 15 g/cm Evaluation Item The photoreceptor and the developer were installed in the combination as shown in Table 3, Examples 1 through 10 and Comparative examples 1 and 2, and 100,000 sheets of copy were taken under the condition of a temperature of 30° C. and a relative humidity of 80%. The evaluation was carried out as to the following items.

An original image including a character image with an image ratio of 7%, a portrait, a solid white image and a solid black image each occupying the quarter area was copied so as to form a A4 size copy image, and copied images of the solid white image, solid black image and line image were evaluated.

The evaluation norms for each item were as follows.

Evaluation of Crack

The surface of the sample coated until the interlayer was visually observed to evaluate the occurrence situation of cracks. Then the photoreceptor was prepared using the sample and subjected to copying of 100,000 sheets, and the evaluation was performed according to the following norms.

Level 1: No crack or a fine crack which is not appeared on the copy image is occurred on the interlayer. No problem is raised on the practical use.

Level 2: A crack is occurred on the interlayer, which is slightly appeared on the copy image. No problem is raised on the practical use.

Level 3: A crack occurred on the interlayer is expanded and grown so that the image thereof is appeared on the copy image. The crack causes a problem on the practical use. Fog: The fog is judged on the copy of the solid white image.

As to the fog, the absolute reflective density of the image on the 100,000th copy was measured by Macbeth RD-918 densitometer after copying. The image density is lowered when the remaining potential is raised, and the fog is occurred when the remaining potential is lowered. The unevenness of the image is made larger when the uniformity of the charged potential is lowered.

A: Density of the solid white image is of the solid white image is less than 0.005; good.

B: Density of the solid white image is not less than 0.05 and less than 0.01; no problem is caused on the practical use.

C: Density of the solid white image is more than 0.01; a problem is caused on the practical use.

Sharpness: The sharpness was judged on the line image.

The $100{,}000^{th}$ copy was repeated copied and the number of distinguishable fine lines was visually judged on the fifth generation of copy.

A: 6 lines/mm or more; good.

B: Not less than 4 lines/mm and not more than 5 lines/mm; no problem is caused on the practical use.

C: Not more than 3 lines/mm; a problem is caused on the practical use.

Unevenness of the Image

After copying of the 100,000 sheets, an original halftone image having a density of 0.4 was copied so that the density of the copied image was to be 0.4 and the difference between the highest density and the lowest density in the same copy (ΔHD=the highest density−the lowest density) was determined to evaluate the unevenness of density of the copied image.

A: ΔHD is not more than 0.05; good.

B: ΔHD is more than 0.05 and less than 0.1; there is no problem on the practical use.

C: ΔHD is more than 0.1; a problem is caused on the practical use.

Black Spot

The black spot occurrence was evaluated by the number of the black spot having a major diameter of not less than 0.4 mm in the 100,000 copies. The major diameter of the black spot can be measured by a microscope with a video printer.

A: The frequency of the black spots having a major diameter of not less than 0.4 mm; all the copied has a number of the black spot of not more than 3/A4 size copy.

B: The frequency of the black spots having a major diameter of not less than 0.4 mm; 1 or more copies have a number of the black spot of from not less than 4 to not more than 19/A4 size copy; no problem is caused on the practical use.

C: The frequency of the black spots having a major diameter of not less than 0.04 mm; 1 or more copies have a number of the black spot of from not less than 20/A4 size copy; a problem is caused on the practical use.

Results of the evaluation are shown in Table 3.

TABLE 3

| Example and Comparative example No. | Photo-receptor No. (Interlayer Coating Liquid No.) | Diameter of aluminum substrate (mm) | Developer and Toner No. | Crack evaluation | Image evaluation | | | |
|---|---|---|---|---|---|---|---|---|
| | | | | | Fog | Sharpness | Unevenness of image | Black spot |
| Example 1 | 1(1) | 30 | 1-1 | Level 1 | A | A | A | A |
| Example 2 | 2(2) | 30 | 1-2 | Level 1 | B | A | A | A |
| Example 3 | 3(3) | 30 | 1-3 | Level 1 | A | A | A | A |
| Example 4 | 4(4) | 30 | 1-4 | Level 1 | B | A | A | A |
| Example 5 | 5(5) | 30 | 1-1 | Level 1 | A | A | A | A |
| Example 6 | 6(6) | 30 | 1-1 | Level 2 | B | A | A | B |
| Example 7 | 7(7) | 30 | 2-1 | Level 1 | A | A | A | A |
| Example 8 | 10(1) | 30 | 2-1 | Level 1 | A | A | A | A |
| Comparative example 1 | 8(8) | 30 | 1-1 | Level 1 | B | C | C | C |
| Comparative example 2 | 9(9) | 30 | 3-1 | Level 3 | B | B | B | C |
| Example 9 | 1(1) | 30 | 1-5 | Level 2 | B | B | A | B |
| Example 10 | 2(2) | 30 | 3-2 | Level 2 | B | B | A | B |
| Example 21 | 21(3) | 40 | 1-3 | Level 1 | B | A | A | A |
| Example 22 | 22(4) | 50 | 1-4 | Level 1 | B | A | A | B |
| Example 23 | 23(5) | 20 | 1-1 | Level 1 | B | A | A | A |
| Example 24 | 24(6) | 15 | 1-1 | Level 2 | B | A | A | B |

As is demonstrated in Table 3, the crack occurrence in the interlayer is inhibited and sufficient properties are confirmed by the image evaluation as to Photoreceptors 1 through 7 and 10 through 14, in Examples 1 through 14, each of which has the aluminum cylindrical support with a diameter of from 15 mm to 50 mm and, provided thereon, the interlayer containing the N-type semiconductive particle according to the invention and the Benard cells are formed therein. On the other hand, the black spots and unevenness of image are much occurred and the sharpness is lowered in the image formed by Photoreceptor 8 in Comparative example 1 using the aluminum cylindrical support with a diameter of 30 mm and the interlayer without the invention only composed of the binder resin in which no Benard cell is formed. Occurrence of the Benard cell is weak and many cracks are formed in the interlayer of Photoreceptor 9 in Comparative example 2 using the cylindrical aluminum support with a diameter of 30 mm and, coated thereon, the interlayer containing silica particles, not semiconductive particles, and many black spots are observed on the copy image. As to the combination of the photoreceptor and the toner, the sharpness is lowered in some degree in Example 9 using the combination with the toner having the variation coefficient of shape coefficient of not less than 16% and in Example 10 using the combination with the toner having the variation coefficient of number of the number distribution coefficient of not less than 27% even though Photoreceptor 1 or 2 according to the invention is used.

Preparation of Photoreceptor 31

The interlayer coating liquids 1 was coated on an aluminum deposited by evaporation polyethylene terephthalate belt support having a diameter of 30 mm to form an interlayer 1 having a thickness of 2 $\mu$m. The drying of the coated layer was slowly performed by low temperature drying so as to stably and easily form the Benard cell so as to prepare the inventive sample. The drying was performed at 60° C. for 10 minutes and then at 40° C. for 30 minutes.

Preparation of Photoreceptors 32 through 39

Interlayer Coating Liquids 32 through 39 were prepared in the same manner as in Interlayer Coating Liquid 1 except that Interlayer Coating Liquid 1 was replaced by each of Interlayer Dispersions 2 through 9, respectively. Photoreceptors 32 through 39 were prepared in the same manner as in Photoreceptor 1 except that Interlayer Coating Liquids 2 through 9 were each used, respectively, in the place of Interlayer Coating Liquid 1. The drying condition was the same as that in the preparation of Photoreceptor 31.

The volume resistivity of dried Interlayers 32 through 39 were within the range of from $0.5\times10^{10}$ Ω·cm to $6\times10^{10}$ Ω·cm under the foregoing measuring condition.

The contents of each of the interlayer were described in Table 4 together with the evaluation on the formation of Benard cell.

The obtained photoreceptors were cut and conveying guide device was added thereto and each of ends were adhered by ultrasonic melting so as to prepare a loop shape belt photoreceptors were prepared. Each of the photoreceptor was installed to a image forming apparatus shown by FIG. 7, having a charging, imagewise exposure, developing, transfer, fixing and cleaning device. A black mono color image was formed by reversal development.

The image forming conditions, the charging condition and the cleaning condition, were as follows. The combinations of the photoreceptor and the toner subjected to the evaluation, Examples 31 through 39 and Comparative examples 31 and 32, are shown in Table 4.

Charging Condition

Charging potential of −650 V

Developing Condition

DC bias: Approximately −500 V

Regulation on developer layer: Magnetic H-Cut method

Developing sleeve diameter: 40 mm

Transfer electrode: Corona charge method, transfer dummy current: 45 $\mu$A

Cleaning Condition

Elastic rubber blade: free length: 9 mm, thickness: 2 mm, hardness: 70°, elasticity: 35, contacting pressure to photoreceptor (line pressure): 15 g/cm The same evaluation mentioned above was conducted. The result is summarized also in Table 4.

TABLE 4

| Example and Comparative example No. | Photoreceptor No. (Interlayer Coating Liquid No.) | Developer and Toner No. | Crack evaluation | Adhesion | Image evaluation | | | |
|---|---|---|---|---|---|---|---|---|
| | | | | | Fog | Sharpness | Unevenness of image | Black spot |
| Example 31 | 31(1) | 1-1 | Level 1 | Level 1 | A | A | A | A |
| Example 32 | 32(2) | 1-2 | Level 1 | Level 1 | B | A | A | A |
| Example 33 | 33(3) | 1-3 | Level 1 | Level 1 | B | A | A | A |
| Example 34 | 34(4) | 1-4 | Level 2 | Level 2 | B | A | A | A |
| Example 35 | 35(5) | 1-1 | Level 1 | Level 1 | A | A | A | A |
| Example 36 | 36(6) | 1-1 | Level 2 | Level 1 | A | A | A | B |
| Example 37 | 37(7) | 2-1 | Level 1 | Level 1 | A | A | A | A |
| Comparative example 31 | 38(8) | 1-1 | Level 3 | Level 3 | B | C | C | C |
| Comparative example 32 | 39(9) | 3-1 | Level 2 | Level 2 | B | B | B | C |
| Example 38 | 31(1) | 1-5 | Level 2 | Level 1 | B | B | A | B |
| Example 39 | 32(2) | 3-2 | Level 2 | Level 1 | B | B | A | B |

As is demonstrated in Table 4, the crack occurrence in the interlayer is inhibited and sufficient properties are confirmed by the image evaluation as to Photoreceptors 31 through 37, in Examples 31 through 37, the interlayer containing the N-type semiconductive particle according to the invention and the Benard cells are formed therein. On the other hand, the black spots and unevenness of image are much occurred and the sharpness is lowered in the image formed by Photoreceptors 38 and 39 in Comparative examples 31 and 32. In Comparative Example 32 the interlayer containing silica particles, not semiconductive particles, small numbers of Benard cells are formed many black spots are observed on the copy image. As to the combination of the photoreceptor and the toner, the sharpness is lowered in some degree in Example 39 using the combination with the toner having the variation coefficient of shape coefficient of not less than 16% and in Comparative Examples 38 and 39 using the combination with the toner having the variation coefficient of number of the number distribution coefficient of not less than 27% even though Photoreceptor 31 or 32 according to the invention is used.

Preparation of Photoreceptors 41 through 50

The above-mentioned Interlayer Coating Liquid 1 was coated by a immersion coating method on a cylindrical aluminum supports having different surface roughness after washing in each, so as to have dry thickness as described in Table 5. In the invention, the drying of the coated layer was slowly performed by low temperature drying so as to stably and easily form the Benard cell. The drying was performed at 60° C. for 10 minutes and then at 40° C. for 30 minutes.

The volume resistively of the dried interlayer after was in the range between $1\times10^{10}$ and $3\times10^{11}$ Ω·cm under the foregoing measuring condition.

Preparation of Photoreceptors 51 through 58

Photoreceptors 51 through 58 were prepared in the same way as preparation method of photoreceptor 44 except that the Interlayer Coating Liquid 1 was replaced by Interlayer Coating Liquid 2 through 9 respectively. The drying condition was same as the photoreceptor 41.

The volume resistively of the dried interlayer after was in the range between $0.5\times10^{10}$ and $6\times10^{10}$ Ω·cm under the foregoing measuring condition.

The contents of each of the interlayer were described in Table 5 together with the evaluation on the formation of Benard cell.

The same evaluation as Examples 1 through 10 was conducted for the obtained samples. The result is summarized in Table 6.

TABLE 5

| Photoreceptor No. | Interlayer No. (Interlayer Coating Liquid No.) | Surface roughness of substrate (Rz, μm) | Surface roughness of interlayer (Rmax, μm) | Thickness of Interlayer | Evaluation of interlayer |
|---|---|---|---|---|---|
| 41 | 41(1) | 0.15 | 0.15 | 0.10 | C |
| 42 | 42(1) | 0.20 | 0.20 | 0.50 | A |
| 43 | 43(1) | 0.20 | 0.30 | 0.50 | A |
| 44 | 44(1) | 0.30 | 1.00 | 1.00 | A |
| 45 | 45(1) | 1.00 | 1.00 | 2.50 | A |
| 46 | 46(1) | 1.80 | 1.80 | 3.50 | A |
| 47 | 47(1) | 2.00 | 0.80 | 3.00 | A |
| 48 | 48(1) | 2.50 | 3.50 | 1.70 | B |
| 49 | 49(1) | 0.30 | 0.15 | 2.00 | A |
| 50 | 50(1) | 0.30 | 3.50 | 2.00 | A |
| 51 | 51(2) | 1.00 | 1.10 | 2.50 | A |
| 52 | 52(3) | 1.00 | 1.00 | 2.50 | A |
| 53 | 53(4) | 1.00 | 0.90 | 2.50 | A |

TABLE 5-continued

| Photoreceptor No. | Interlayer No. (Interlayer Coating Liquid No.) | Surface roughness of substrate (Rz, μm) | Surface roughness of interlayer (Rmax, μm) | Thickness of Interlayer | Evaluation of interlayer |
|---|---|---|---|---|---|
| 54 | 54(5) | 1.00 | 1.00 | 2.50 | A |
| 55 | 55(6) | 1.00 | 1.10 | 2.50 | A |
| 56 | 56(7) | 1.00 | 2.50 | 2.50 | B |
| 57 | 57(8) | 1.00 | 2.50 | 2.50 | D |
| 58 | 58(9) | 1.00 | 2.50 | 2.50 | C |

TABLE 6

| Example and Comparative example No. | Photoreceptor and Interlayer No. (Interlayer Coating Liquid No.) | Developer and Toner No. | Crack evaluation | Adhesion | Image evaluation | | | |
|---|---|---|---|---|---|---|---|---|
| | | | | | Fog | Sharpness | Unevenness of image | Black spot |
| Example 41 | 41(1) | 1-1 | Level 2 | Level 3 | C | B | C | C |
| Example 42 | 42(1) | 1-1 | Level 2 | Level 2 | A | A | A | B |
| Example 43 | 43(1) | 1-1 | Level 2 | Level 1 | A | A | A | A |
| Example 44 | 44(1) | 1-1 | Level 1 | Level 1 | A | A | A | A |
| Example 45 | 45(1) | 1-1 | Level 1 | Level 1 | A | A | A | A |
| Example 46 | 46(1) | 1-1 | Level 1 | Level 1 | A | A | A | A |
| Example 47 | 47(1) | 1-1 | Level 1 | Level 1 | A | A | A | A |
| Example 48 | 48(1) | 1-1 | Level 2 | Level 2 | A | A | A | C |
| Example 49 | 49(1) | 1-1 | Level 2 | Level 2 | A | A | A | A |
| Example 50 | 50(1) | 1-1 | Level 2 | Level 2 | A | A | A | B |
| Example 51 | 51(2) | 1-2 | Level 1 | Level 1 | A | A | A | A |
| Example 52 | 52(3) | 1-3 | Level 1 | Level 1 | A | A | A | A |
| Example 53 | 53(4) | 1-4 | Level 2 | Level 2 | B | A | A | A |
| Example 54 | 54(5) | 1-1 | Level 1 | Level 1 | A | A | A | A |
| Example 55 | 55(6) | 1-1 | Level 1 | Level 1 | A | A | A | B |
| Example 56 | 56(7) | 2-1 | Level 1 | Level 1 | A | A | A | A |
| Example 57 | 57(8) | 1-1 | Level 3 | Level 3 | B | C | C | C |
| Example 58 | 58(9) | 3-1 | Level 2 | Level 2 | B | B | B | C |
| Example 59 | 44(1) | 1-5 | Level 2 | Level 1 | B | B | A | B |
| Example 60 | 44(1) | 3-2 | Level 2 | Level 1 | B | B | A | B |

The adhesive ability of the interlayer is sufficient and the occurrence of the crack is inhibited in Photoreceptors 42 through 47, in Combination Nos. 42 through 47, and Photoreceptors 49 through 56, in Combination Nos. 49 through 56, according to the invention, and good characteristics are shown in the image evaluation by these photoreceptors. In contrast, no Benard cell is formed in the image formed by Photoreceptor 58, in Combination No. 58, using the interlayer without the invention only composed of binder resin. Consequently the black spots and unevenness of image are much occurred and the sharpness is lowered in the copy image formed by such the photoreceptor. Besides, the black spots are considerably occurred by Photoreceptor 48, in Combination No. 48, having a support surface roughness Rz of 2.5 μm even though the interlayer thereof contains the N-type semiconductive particles. In Photoreceptor 41, in Combination No. 41, having a thin interlayer in which no Benard cell is formed, the adhesive ability of the interlayer is insufficient; and the fog and the black spot are considerably occurred in the copy formed by the photoreceptor. The formation of the Benard cell is weak and the occurrence of the crack is frequent in the interlayer in Photoreceptor 58, in Combination No. 58, using the silica particles, so that many black spots are occurred in the copy formed by this photoreceptor. As to the combination of the photoreceptor and the toner, the sharpness is lowered in some degree in Combination No. 59 using the combination with the toner having the variation coefficient of shape coefficient of not less than 16%, and in Combination No. 60 using the combination with the toner having the variation coefficient of number of the number distribution coefficient of not less than 27% even though the photoreceptor according to the invention is used.

The crack peculiarly occurred in the interlayer coated on a support having a small diameter is inhibited in the photoreceptor according to the invention which comprises a cylindrical support having a diameter of from 10 to 50 mm, having specific surface roughness, or belt shape support, and, coated thereon, the interlayer in which the N-type semiconductive particles are contained and the Benard cells are formed. Consequently, the black spot peculiarly occurred by the reversal development is considerably inhibited and an electrophotographic image with suitable sharpness can be provided. Moreover, a good electrophotographic image can be provided by the image forming method, image forming apparatus and the processing cartridge using the combination of the photoreceptor with the toner having a small variation of the shape coefficient and the particle diameter distribution.

The adhesion ability between the support and the interlayer or between the interlayer and the photoreceptive layer is raised in the photoreceptor according to the invention having the support with the surface roughness of from 0.2 to 2.0 μm and the interlayer in which the N-type semiconductive particles are contained and the Benard cells are occurred. The black spot peculiarly occurred by the reversal development is considerably inhibited and a good electrophotographic imaged can be provided by such the photoreceptor. Moreover, a good electrophotographic image can be provided by the image forming method, image forming apparatus and the processing cartridge using the combination of the photoreceptor with the toner having a small variation of the shape coefficient and the particle diameter distribution.

What is claimed is:

1. An electrophotographic photoreceptor having an insulating interlayer between an electroconductive support and a photoreceptive layer, wherein the interlayer contains an N-type semiconductive particle and a binder and a Benard cell is formed in the interlayer.

2. The electrophotographic photoreceptor of claim 1, where the N-type semiconductive particle is subjected to plural times of surface treatment and the final surface treatment is carried out by using a reactive organic silicon compound.

3. The electrophotographic photoreceptor of claim 2, wherein the reactive organic silicon compound is methylhydrogenepolysiloxane.

4. The electrophotographic photoreceptor of claim 2, wherein the organic silicon compound is a compound represented by the following Formula 1:

$$R—Si—(X)_a \qquad \text{Formula 1}$$

wherein the formula, R is an alkyl group or an aryl group, and X is a methoxy group, an ethoxy group or a halogen atom.

5. The electrophotographic photoreceptor of claim 4, wherein the number of the carbon atoms in the group represented by R in Formula 1 is from 4 to 8.

6. The electrophotographic photoreceptor of claim 2, wherein at least one of the plural times of the surface treatments is a treatment by a compound selected from the group consisting of alumina, silica and zirconia.

7. The electrophotographic photoreceptor described in any one of the foregoing 1 through 6, wherein the N-type semiconductive particle is subjected to a surface treatment by an organic silicon compound having a fluorine atom.

8. The electrophotographic photoreceptor of claim 1, wherein the N-type semiconductive particle has a number average primary particle diameter of from 10 nm to 200 nm.

9. The electrophotographic photoreceptor of claim 1, wherein the N-type semiconductive particle is a metal oxide particle.

10. The electrophotographic photoreceptor of claim 9, wherein the N-type semiconductive particle is a titanium oxide particle.

11. The electrophotographic photoreceptor of claim 1, wherein the binder of the interlayer is a polyamide resin.

12. The electrophotographic photoreceptor of claim 1, wherein the interlayer has a dry thickness of from 0.2 to 15 $\mu$m.

13. The electrophotographic photoreceptor of claim 1, wherein the roughness Rz of a surface of the conductive support is from 0.2 to 2.0 $\mu$m.

14. The electrophotographic photoreceptor of claim 1, wherein the roughness Rmax of a surface of the conductive support is from 0.2 to 3.0 $\mu$m.

15. The electrophotographic photoreceptor of claim 1, wherein the roughness Rmax of a surface of the conductive support is from 0.2 to 3.0 $\mu$m.

16. The electrophotographic photoreceptor of claim 1, wherein the conductive support is a flexible belt.

17. An image forming method which the steps of charging, light exposing, developing by a toner and transferring are repeated by rotation of an electrophotographic photoreceptor, wherein the electrophotographic photoreceptor is the electrophotographic photoreceptor described in claim 1, and the toner to be used has a variation coefficient of the shape coefficient of not more than 16%, and a variation coefficient of the number particle diameter distribution of not more than 27%.

18. The image forming method of claim 17, wherein the toner contains toner particles each having a shape coefficient of from 1.0 to 1.6 in a ratio of not less than 65% in number.

19. The image forming method of claim 17, wherein the toner contains toner particles each having the shape coefficient of from 1.2 to 1.6 in a ratio of not less than 65% in number.

20. The image forming method of claim 17, wherein the toner contains a toner particle having no corner in a ratio of not less than 50% in number.

21. The image forming method of claim 17, wherein the toner has a number average diameter of from 3 to 8 $\mu$m.

22. The image forming method of claim 17, wherein the sum M of a relative frequency of the toner particles included in the highest frequency class $m_1$ and a relative frequency of the toner particles included in the next high frequency class $m_2$ is not less than 70% in a histogram showing a particle diameter distribution in number which is classified into plural classes every 0.23 of natural logarithm ln D graduated on the horizontal axis of the histogram, where D is the diameter of the toner particle in $\mu$m.

23. The image forming method of claim 17, wherein the toner comprises a colored particle produced by polymerizing a polymerizable monomer in an aqueous medium.

24. The image forming method of claim 17, wherein the toner comprises a colored particle produced by associating polymer particles in an aqueous medium.

25. The image forming method of claim 17, wherein the toner comprises a styrene acrylate resin or a styrene methacrylate resin.

26. A processing cartridge comprises the electrophotographic photoreceptor of claim 1 and at least one of a charging means, a imagewise light exposing means, a developing means and a cleaning means combined into a unit so as to be freely put into and taken out from the image forming apparatus.

* * * * *